US008304975B2

(12) United States Patent
Tsukamoto et al.

(10) Patent No.: US 8,304,975 B2
(45) **Date of Patent: *Nov. 6, 2012**

(54) ELECTRON BEAM APPARATUS AND IMAGE DISPLAY APPARATUS USING THE SAME

(75) Inventors: Takeo Tsukamoto, Atsugi (JP); Ouichi Kubota, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

This patent is subject to a terminal disclaimer.

(21) Appl. No.: 12/903,559

(22) Filed: Oct. 13, 2010

(65) Prior Publication Data

US 2011/0084597 A1 Apr. 14, 2011

Related U.S. Application Data

(63) Continuation of application No. 12/421,787, filed on Apr. 10, 2009, now Pat. No. 7,859,184.

(30) Foreign Application Priority Data

Apr. 10, 2008 (JP) ..... 2008-102624

(51) Int. Cl.
*H01J 1/62* (2006.01)

(52) U.S. Cl. ..... 313/495; 313/309; 313/336; 313/351

(58) Field of Classification Search ..... 313/309, 313/310, 336, 351, 495
See application file for complete search history.

(56) References Cited

U.S. PATENT DOCUMENTS

| | | | | |
|---|---|---|---|---|
| 4,904,895 | A | 2/1990 | Tsukamoto et al. | 313/336 |
| 5,382,867 | A | 1/1995 | Yuji et al. | 313/309 |
| 5,679,960 | A | 10/1997 | Akama | 257/10 |
| 5,786,658 | A | 7/1998 | Tsukamoto et al. | 313/309 |
| 5,847,495 | A | 12/1998 | Yamanobe et al. | 313/310 |
| 5,986,389 | A | 11/1999 | Tsukamoto | 313/310 |
| 6,147,449 | A | 11/2000 | Iwasaki et al. | 313/495 |
| 6,171,162 | B1 | 1/2001 | Iwasaki et al. | 445/6 |
| 6,179,678 | B1 | 1/2001 | Kishi et al. | 445/24 |
| 6,184,610 | B1 | 2/2001 | Shibata et al. | 313/309 |
| 6,231,413 | B1 | 5/2001 | Tsukamoto | 445/24 |
| 6,246,168 | B1 | 6/2001 | Kishi et al. | 313/495 |
| 6,288,494 | B1 | 9/2001 | Tsukamoto et al. | 315/169.1 |
| 6,435,928 | B1 | 8/2002 | Tsukamoto | 445/24 |
| 6,472,814 | B1 | 10/2002 | Yamanobe et al. | 313/495 |

(Continued)

FOREIGN PATENT DOCUMENTS

EP 0 535 953 A2 4/1993

(Continued)

OTHER PUBLICATIONS

European Search Report issued in the counterpart application No. 09156426.0 dated Jun. 1, 2010.

(Continued)

*Primary Examiner* — Vip Patel
(74) *Attorney, Agent, or Firm* — Fitzpatrick, Cella, Harper & Scinto

(57) ABSTRACT

There is provided a new electron beam apparatus which improves the instability of an electron emission characteristic and provides a high efficient electron emission characteristic. The electron beam apparatus includes: an insulating member having a recess on its surface; a cathode having a protruding portion extending over the outer surface of the insulating member and the inner surface of the recess; a gate positioned at the outer surface of the insulating member in opposition to the protruding portion; and an anode positioned in opposition to the protruding portion through the gate.

34 Claims, 19 Drawing Sheets

U.S. PATENT DOCUMENTS

| | | | | |
|---|---|---|---|---|
| 6,515,640 | B2 | 2/2003 | Tsukamoto et al. | 345/75.2 |
| 6,608,437 | B1 | 8/2003 | Kishi et al. | 313/495 |
| 6,626,719 | B2 | 9/2003 | Ono et al. | 445/24 |
| 6,843,696 | B2 | 1/2005 | Kitamura et al. | 445/24 |
| 6,848,962 | B2 | 2/2005 | Kitamura et al. | 445/24 |
| 6,858,990 | B2 | 2/2005 | Tsukamoto | 315/169.1 |
| 6,900,581 | B2 | 5/2005 | Kyogaku et al. | 313/310 |
| 6,948,995 | B2 | 9/2005 | Ishikura et al. | 445/51 |
| 7,012,362 | B2 | 3/2006 | Kawate et al. | 313/495 |
| 7,034,444 | B2 | 4/2006 | Tsukamoto | 313/309 |
| 7,057,336 | B2 | 6/2006 | Kishi et al. | 313/495 |
| 7,064,475 | B2 | 6/2006 | Kuroda et al. | 313/311 |
| 7,067,336 | B1 | 6/2006 | Kyogaku et al. | 438/20 |
| 7,074,105 | B2 | 7/2006 | Kawate et al. | 445/51 |
| 7,074,380 | B2 | 7/2006 | Iwaki et al. | 423/447.3 |
| 7,094,123 | B2 | 8/2006 | Oyama et al. | 445/50 |
| 7,131,886 | B2 | 11/2006 | Kitamura et al. | 445/51 |
| 7,147,533 | B2 | 12/2006 | Kawate et al. | 445/49 |
| 7,186,160 | B2 | 3/2007 | Tsukamoto | 445/50 |
| 7,198,966 | B2 | 4/2007 | Kitamura et al. | 438/20 |
| 7,227,311 | B2 | 6/2007 | Tsukamoto | 315/169.3 |
| 7,234,985 | B2 | 6/2007 | Kishi et al. | 445/24 |
| 7,258,590 | B2 | 8/2007 | Oyama et al. | 445/50 |
| 7,399,215 | B2 | 7/2008 | Tsukamoto | 445/51 |
| 7,419,416 | B2 | 9/2008 | Tsukamoto | 445/24 |
| 7,432,883 | B2 | 10/2008 | Oyama et al. | 345/75.2 |
| 7,442,404 | B2 | 10/2008 | Kuroda et al. | 427/74 |
| 7,459,844 | B2 | 12/2008 | Tsukamoto | 313/495 |
| 7,528,538 | B2 | 5/2009 | Kitamura et al. | 313/495 |
| 7,582,001 | B2 | 9/2009 | Kitamura et al. | 445/50 |
| 2003/0124944 | A1 | 7/2003 | Kyogaku et al. | 445/6 |
| 2004/0174110 | A1 | 9/2004 | Ito | 313/310 |
| 2005/0287689 | A1 | 12/2005 | Iwaki et al. | 438/22 |
| 2006/0228478 | A1 | 10/2006 | Iwaki et al. | 427/249.1 |
| 2007/0141943 | A1 | 6/2007 | Kawate et al. | 445/50 |
| 2007/0188067 | A1 | 8/2007 | Tsukamoto et al. | 313/309 |
| 2008/0045112 | A1 | 2/2008 | Kishi et al. | 445/24 |
| 2008/0106181 | A1 | 5/2008 | Kawate et al. | 313/495 |
| 2009/0180946 | A1 | 7/2009 | Kitamura et al. | 423/447.3 |
| 2009/0237570 | A1 | 9/2009 | Moriguchi et al. | 348/725 |
| 2009/0256464 | A1 | 10/2009 | Tsukamoto et al. | 313/310 |
| 2009/0284119 | A1 | 11/2009 | Takeda et al. | 313/235 |
| 2009/0284123 | A1 | 11/2009 | Nishida et al. | 313/311 |
| 2009/0284127 | A1 | 11/2009 | Takeuchi et al. | 313/495 |
| 2010/0053126 | A1 | 3/2010 | Kobayashi et al. | 325/204 |
| 2010/0060141 | A1 | 3/2010 | Kubota et al. | 313/496 |

FOREIGN PATENT DOCUMENTS

| | | | |
|---|---|---|---|
| EP | 0 665 571 | A1 | 8/1995 |
| EP | 1 324 366 | A2 | 7/2003 |
| EP | 1324366 | | 7/2003 |
| JP | 2000-251629 | | 9/2000 |
| JP | 2001-167693 | | 6/2001 |

OTHER PUBLICATIONS

Notification of the First Office Action issued by the State Intellectual Property Office of the People's Republic of China dated Jul. 1, 2010 in the counterpart application No. 200910133527.0.

ELECTRON BEAM APPARATUS AND IMAGE DISPLAY APPARATUS USING THE SAME

CROSS REFERENCE TO RELATED APPLICATIONS

This application is a continuation of U.S. patent application Ser. No. 12/421,787, filed Apr. 10, 2009, now U.S. Pat. No. 7,859,184 and claims priority to Japanese Patent Application No. 2008-102624, filed Apr. 10, 2008, each of which is incorporated by reference herein in its entirety, as if set forth fully herein.

BACKGROUND OF THE INVENTION

1. Field of the Invention

The present invention relates to an electron beam apparatus using a field emission (FE) electron-emitting device and an image display apparatus using the same.

2. Description of the Related Art

Until now there has been an electron-emitting device in which a large number of electrons emitted from a cathode collide a gate electrode opposing the cathode, are scattered and then taken out as electrons.

As a device for emitting electrons in such a manner, there have been known a surface-conduction electron-emitting device and a stack electron-emitting device described in Japanese Patent Application Laid-Open No. 2001-167693.

Japanese Patent Application Laid-Open No. 2001-167693 describes an electron-emitting device which is of a stack type and the insulating layer of which is concave inward (referred to as "recess portion" hereinafter).

In the disclosure of Japanese Patent Application Laid-Open No. 2001-167693, the insulating layer forming the recess portion uses a PSG ($SiO_2$ doped with phosphorus) material and the PSG layer is 10 nm in thickness. The tip position (height) of the cathode from the substrate coincides with the height position of the insulating layer having the cathode on its side wall.

In Japanese Patent Application Laid-Open No. 2001-167693, the efficiency the electron emission characteristic is excellent, however, the temporal stability thereof has been required to be improved.

The present invention has been made to solve the problems of the above conventional art and has for its object to provide an electron beam apparatus which is simple in configuration, high in electron emission efficiency and stably operates and an image display apparatus provided therewith.

SUMMARY OF THE INVENTION

The invention of the present application for solving the above problems provides an electron beam apparatus includes: an insulating member having a recess on its surface; a cathode having a protruding portion extending over the outer surface of the insulating member and the inner surface of the recess; a gate positioned at the outer surface of the insulating member in opposition to the protruding portion; and an anode positioned in opposition to the protruding portion through the gate.

The invention of the present application also provides an image display apparatus including the above electron beam apparatus and a light emitting member which emits light by irradiation with electrons and is provided on the anode.

The invention of the present application provides the electron beam apparatus which is small in temporal variation of the electron emission efficiency and stable in operation. Furthermore, the present invention provides the electron beam apparatus the shape of the electron emission portion of which is immune to change. Still furthermore, the present invention provides the electron beam apparatus which minimizes the generation of discharge around the electron emission portion and also provides the image display apparatus using the electron beam apparatus.

Further features of the present invention will become apparent from the following description of exemplary embodiments with reference to the attached drawings.

DESCRIPTION OF THE EMBODIMENTS

Exemplary embodiments of the present invention are exemplarily described in detail below with reference to the drawings.

First of all, the configuration of the electron-emitting device capable of stably emitting electrons according to the present embodiment is described.

Figure 1A:
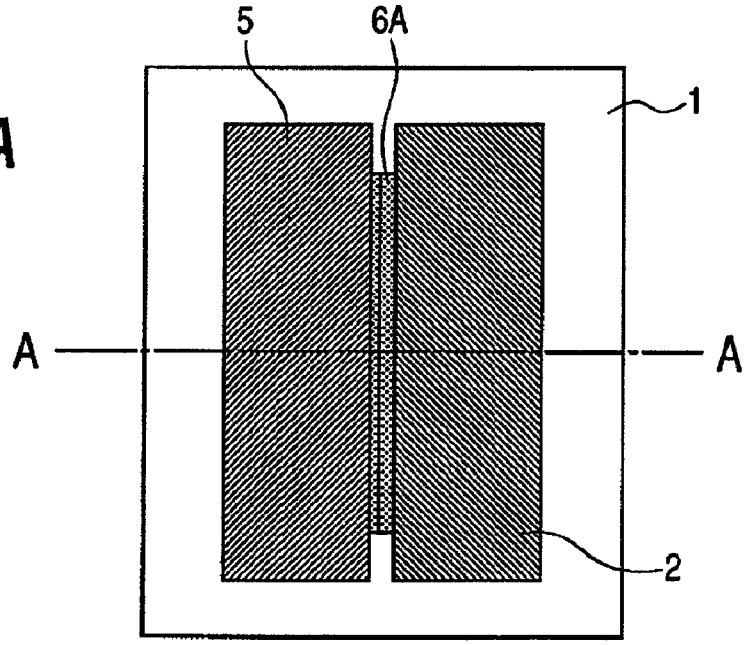
FIGS. 1A, 1B and 1C are a set of partial views of a first embodiment of the present invention.
Figure 1B:
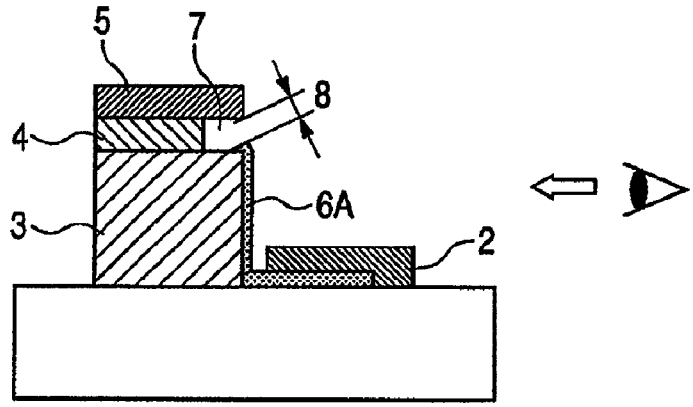
Figure 1C:
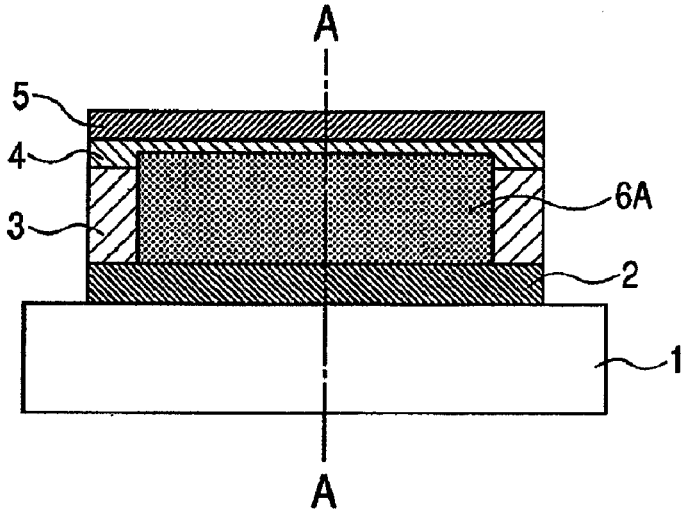

FIG. 1A is a plan schematic diagram of the electron-emitting device according to the embodiment of the present invention. FIG. 1B is a cross section taken along the line A-A of FIG. 1A. FIG. 1C is a side view when the device is viewed from the direction indicated by the arrow in FIG. 1B.

In FIGS. 1A, 1B and 1C, insulating layers 3 and 4 form an insulating member. In the present embodiment, the member forms a step on the surface of a substrate 1. A gate electrode 5 is positioned in the upper portion of outer surface of the insulating member. A cathode 6A is positioned on the outer surface of the insulating layer 3 being a part of the insulating member, has a protruding portion serving as an electron emission portion and is electrically connected to an electrode 2 in the present embodiment. A recess portion (recess) 7 is formed such that the side portion of the insulating layer 4 is retracted inside to be concaved with respect to the side portion of the insulating layer 3 being a part of the insulating member and the side portion of the gate electrode 5. Although not illustrated in FIGS. 1A, 1B and 1C, there is provided an anode electrode which is positioned in opposition to the cathode 6A through the gate electrode 5 (interposed between the cathode 6A and the anode electrode) and set to higher electric potential than the gate electrode 5 and the cathode 6A (refer to reference numeral 20 in FIG. 2). A gap 8 between which an electric field required for emitting electrons is formed represents the shortest distance "d" between the tip of the cathode 6A and the bottom surface (portion opposing the recess) of the gate electrode 5.

There is described herein a characteristic and a desirable shape of protruding portion of the cathode 6A positioned with the cathode 6A brought into contact with the inner surface of the recess, which is a characteristic of the present invention. In the following, the surface of the insulating member formed of the insulating layers 3 and 4 is described by using different expression of the outer surface and the inner surface of the recess on a part basis. Specifically, the upper surface portion of the insulating layer 3 forming the recess of the insulating member and the side portion of the insulating layer 4 are referred to as the inner surface of the recess and the surfaces of other portions of the insulating layers 3 and 4 are referred to as the outer surface.

Figure 5:
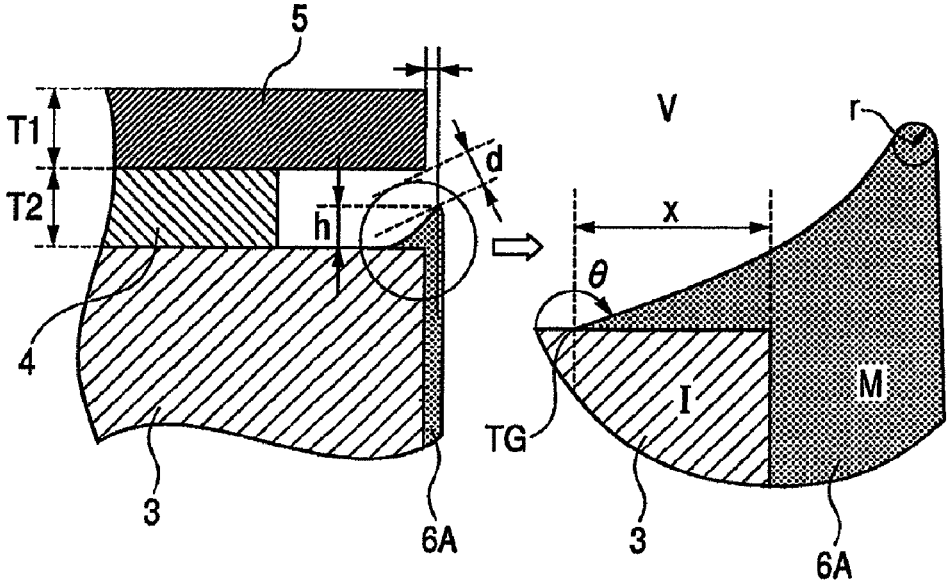
FIG. 5 is an enlarged side view in the vicinity of the electron emission portion of the electron-emitting device of the present invention.

FIG. 5 is an enlarged cross section of the protruding portion of the cathode 6A.

The enlargement of tip portion of the protruding portion shows that the tip portion is of a protruded shape typified by radius of curvature "r". Electric field strength at the tip portion is varied with the radius of curvature "r". The smaller the radius of curvature "r", the highly the line of electric force is concentrated, enabling a higher electric field to be formed at the tip of the protruding portion. If electric field is made constant at the tip of the protruding portion, that is to say, if a driving electric field is made constant, a distance "d" between the tip portion of the cathode 6A and the gate electrode is great if the radius of curvature is relatively small, but the distance "d" is small if the radius of curvature "r" is relatively great. Since a difference in the distance "d" influences a difference in the number of scattering times, the smaller the radius of curvature "r" and the greater the distance "d", the higher the device in efficiency.

In other words, the efficiency is increased by the tip shape effect of the cathode, which means that SI in the following equation (3) can be made greater under the condition that the efficiency is constant. This strengthens the gate structure to enable supplying a stable device capable of being driven for a long time.

The protruding portion used in the present invention is formed to enter the inner surface of the recess of the insulating member forming the step on the substrate to a depth (distance) of "x" as illustrated in FIG. 5. The shape depends on a method of forming the cathode which forms the electron emission portion. In EB vapor deposition, a thickness indicated by T1 and T2 as well as angle and time in vapor deposition are parameters. It is generally difficult to control the shape by the sputtering formation method because of its large infiltration. For this reason, there is required a special particle adhesion mechanism in addition to the consideration of spatter pressure, kind of gas, moving direction with the substrate.

An electron emitting material (a material for the cathode 6A) entering the inner surface of the recess to a depth (distance) of "x" produces the following three advantages: 1) the protruding portion of the cathode serving as the electron emission portion is brought into contact with the wide area of the insulating layer 3 to increase a mechanical adhesion strength (increase in adhesion strength); 2) a thermal contact area is increased between the protruding portion of the cathode serving as the electron emission portion and the insulating layer to enable heat generated in the electron emission portion to be efficiently escaped to the insulating layer 3 (reduction in thermal resistance); 3) the electron emitting material entering the recess at a gentle slope reduces an electric field strength at a triple junction generated at the interface among the insulating layer, vacuum and metal, enabling preventing electrical discharge phenomenon from being caused due to the generation of an abnormal electric field; 4) the portion on the recess side of the protruding portion is slanted (particularly in the vicinity of the electron emission portion) with respect to a normal line extended from the surface of the gate electrode portion (the lower surface of the gate electrode) opposing the recess of the insulating layer, thereby forming an electric potential distribution in which electrons emitted from the tip easily jump outside the recess to increase an electron emission efficiency. Incidentally, a distance "x," in other words, refers to one between the end of the portion being in contact with the inner surface of the recess and the edge of the recess of the protruding portion.

The advantage item 2 descried above is further described in detail below.

Figure 6A:
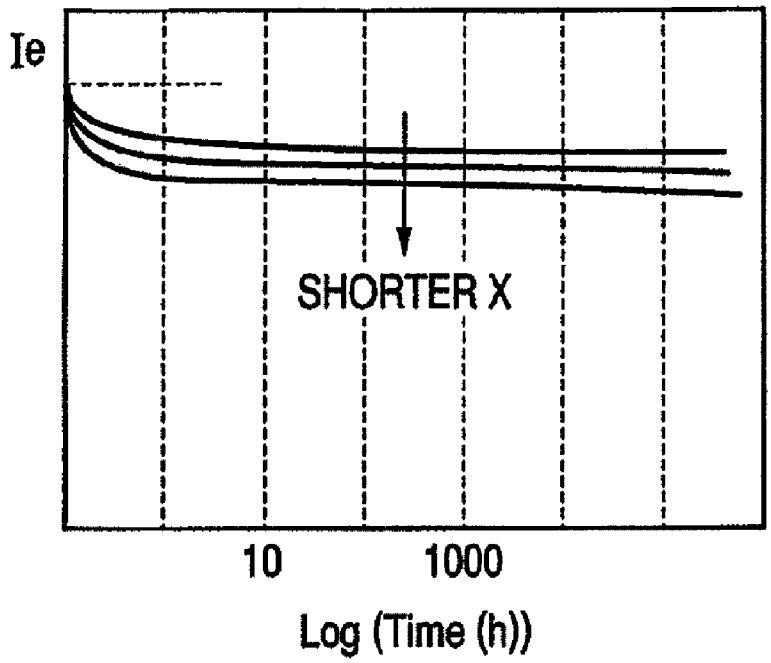
FIGS. 6A and 6B are graphs illustrating variation in an initial characteristic of the electron-emitting device and a relationship between an amount of infiltration into the recess and variation in device characteristic.

FIG. 6A is a graph illustrating an initial Ie as a function of time in the case where an amount "x" of entrance of the cathode material into the recess is varied. Incidentally, the Ie means an electron emission amount being an amount of electrons reaching the anode 20 in FIG. 2 described later. An average electron emission amount Ie detected for the first 10 seconds after the device started to be driven is normalized as an initial value and change in the electron emission amount is plotted against the common logarithm of time.

An initial reduction in the electron emission amount obviously tended to increase as an amount of entrance of the electron emission material (the material for the protruding portion of the cathode) into the recess is decreased.

Figure 6B:
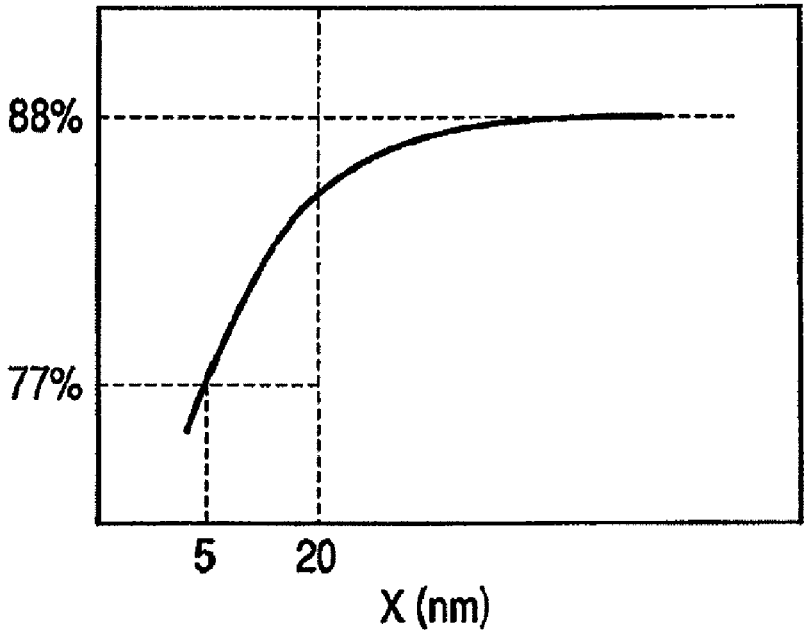

Several devices were measured in the same manner as in FIG. 6A. An initial electron emission amount for an amount "x" of entrance of the electron emission material into the recess was normalized as 100. FIG. 6B is a graph illustrating the electron emission amount plotted one hour after measurement. As is clear from the figure, the smaller the amount of entrance of the electron emission material (the material for the protruding portion of the cathode) into the recess, the greater the initial reduction. When the amount of entrance of the electron emission material (the material for the protruding portion of the cathode) exceeds 20 nm, the dependency of the amount "x" of entrance tended to be small.

Inferring from the result, the increase of the amount "x" of entrance of the electron emission material (the material for the protruding portion of the cathode) into the recess causes the electron emission material to be brought into contact with a wide area of the insulating layer 3 to reduce thermal resistance. In addition to that, it is presumed that action of increase in heat capacity of the electron emission portion (the protruding portion of the cathode) due to the increase of volume lowers temperature in the tip of an electrically conducting layer to thereby decrease the initial fluctuation.

It does not mean that the greater the entrance distance "x" of the protruding portion of the cathode into the recess, the better. In general, the value "x" is set to approximately 10 nm to 30 nm. The entrance distance controls angle at the time of vapor deposition of the protruding portion of the cathode serving as the electron emission portion, thickness T2 of the insulating layer 4 forming the recess and thickness T1 of the gate are controlled to control the entrance distance "x". The distance "x" is desirably more than 20 nm. However, if the distance "x" is too long, a leak occurs between the cathode 6A and the gate through the inner surface of the recess (or the side of the insulating layer 4) to increase a leak current.

The triple junction is described below. In general, a place where three kinds of materials such as a vacuum, insulator and metal different in dielectric constant are in contact with each other at one point is referred to as triple junction. The electric field being excessively higher at the triple junction than that in the environment depending on conditions sometimes causes electric discharge. Also in the present configuration, a place TG illustrated in FIG. 5 indicates the triple junction. If an angle θ at which the protruding portion of the cathode 6A is in contact with the insulating layer is 90 degrees or more, the electric field is not widely different from than the ambient electric field. In the case where the protruding portion of the cathode is detached from the insulating layer 3 for some reasons for insufficient mechanical strength, for example, the angle θ decreases to 90 degrees or less to form a strong electric field. At this point, the strong electric field is formed at the interface where the protruding portion is detached, so that the device may be broken down due to the emission of electrons from the TG point or creeping discharge triggered by the emission of electrons.

For this reason, a desirable angle θ at which the protruding portion of the cathode 6A is in contact with the insulating layer is 90 degrees or more.

Figure 2:
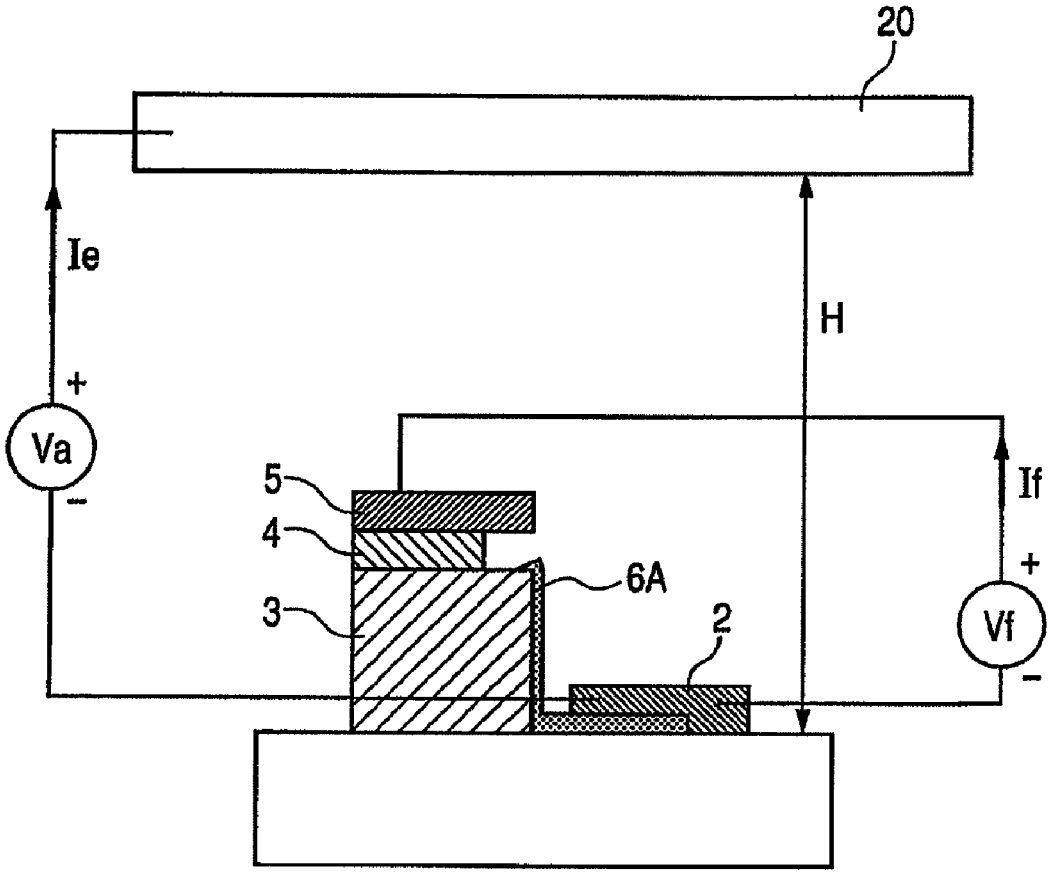
FIG. 2 is a schematic diagram illustrating the configuration for measuring a characteristic of the electron-emitting device of the present invention.

There is described below the orbit of an electron emitted by applying a voltage to the device as illustrated in FIG. 2.

FIG. 2 is a schematic diagram illustrating the electron-emitting device of the present invention and relationship between a power supply and electric potential in measuring the electron emission characteristic of the device. A voltage Vf is applied between the cathode and the gate, a device current If flows at this point, a voltage Va is applied between the cathode and the anode and an electron emission current Ie flows.

An efficiency η is given by an equation of the efficiency η=Ie/(If+Ie) using the current If detected when the voltage is applied to the device and the current Ie taken out in the vacuum.

Figure 3:
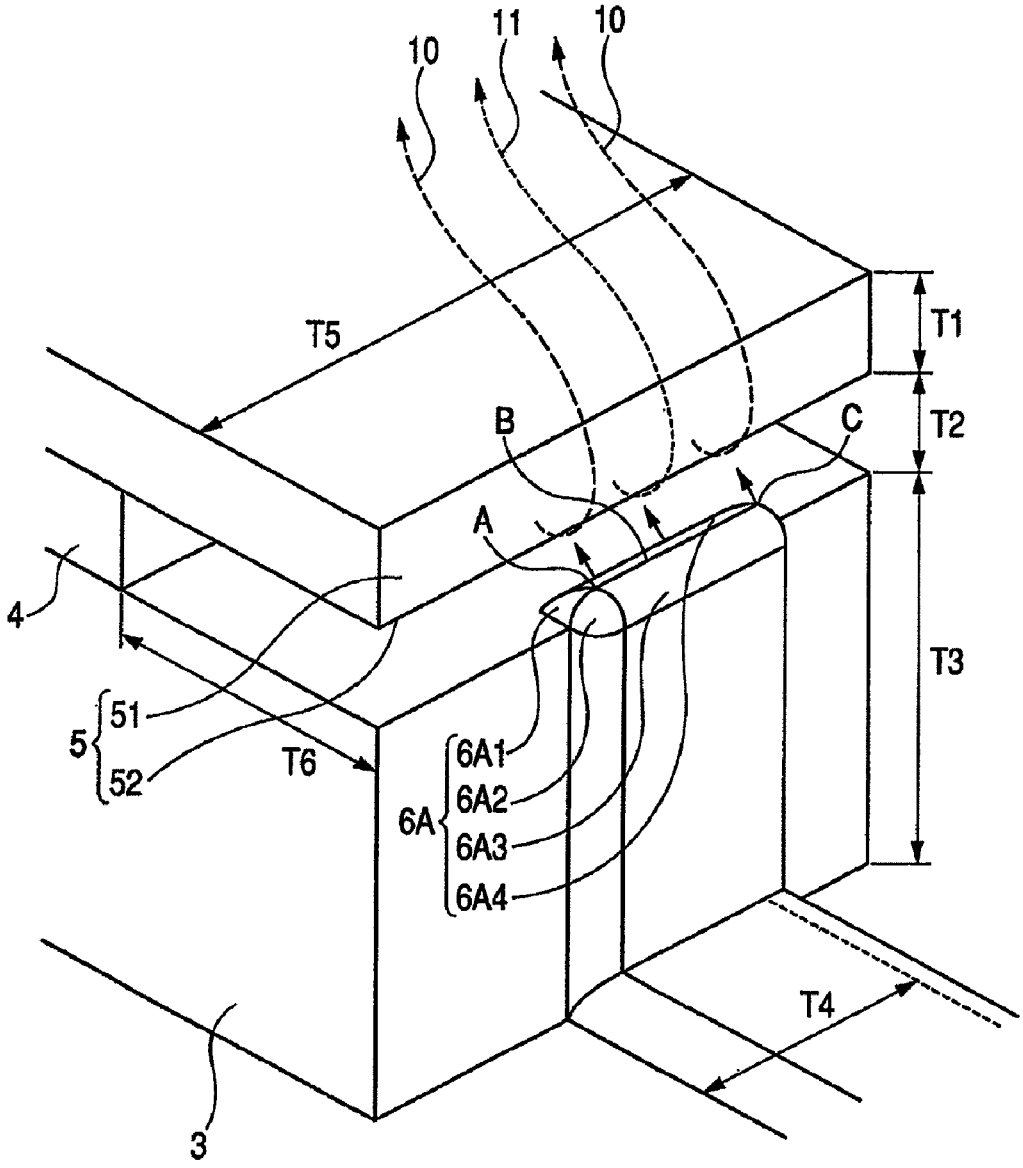
FIG. 3 is an enlarged perspective view in the vicinity of the electron emission portion of the electron-emitting device of the present invention.

FIG. 3 is an enlarged schematic diagram illustrating the electron emission portion in such an arrangement. In FIG. 3, the insulating layers 3 and 4 form the insulating member. The side 51 and the bottom face 52 (the face opposing the recess of the insulating member) of the gate electrode are provided. Faces 6A-1, 6A-2, 6A-3 and 6A-4 are surface elements into which the cathode 6A having the protruding portion acting as the electron emission portion is dissolved.

Description of Scattering in Electron Emission

In FIG. 3, some of electrons emitted from the end (the protruding portion) of the strip-shaped cathode 6A toward the opposing gate electrode 5 collide with the gate electrode 5 and some of them do not collide with the gate electrode 5. A place where electrons collide with the gate electrode is roughly separated to the side 51 of the gate electrode and the portion 52 opposing the recess of the insulating member (or the opposite face of the gate electrode) of the gate electrode. Most of electrons collide with the side 51. The electrons colliding with the gate electrode 5 are isotropically scattered irrespective whether the electrons collide with the side or the opposite face 52 of the gate electrode. Whether electrons are scattered on the side 51 or on the opposite face 52 significantly influences efficiency. The end (the protruding portion) of the strip-shaped cathode 6A is alienated from the gate electrode as much as possible to reduce the scattering of electrons on the opposite face 52 of the gate electrode, thereby enabling an electron emission efficiency to be improved.

Most of the electrons scattered on the gate electrode 5 are elastically scattered (multiply scattered) several times. On the upper portion of the gate electrode 5, electrons cannot be scattered and jump to the anode side.

As described above, the reduction of the number of electrons being scattering on the gate electrode (the number of times of drop) improves the efficiency.

Figure 4:
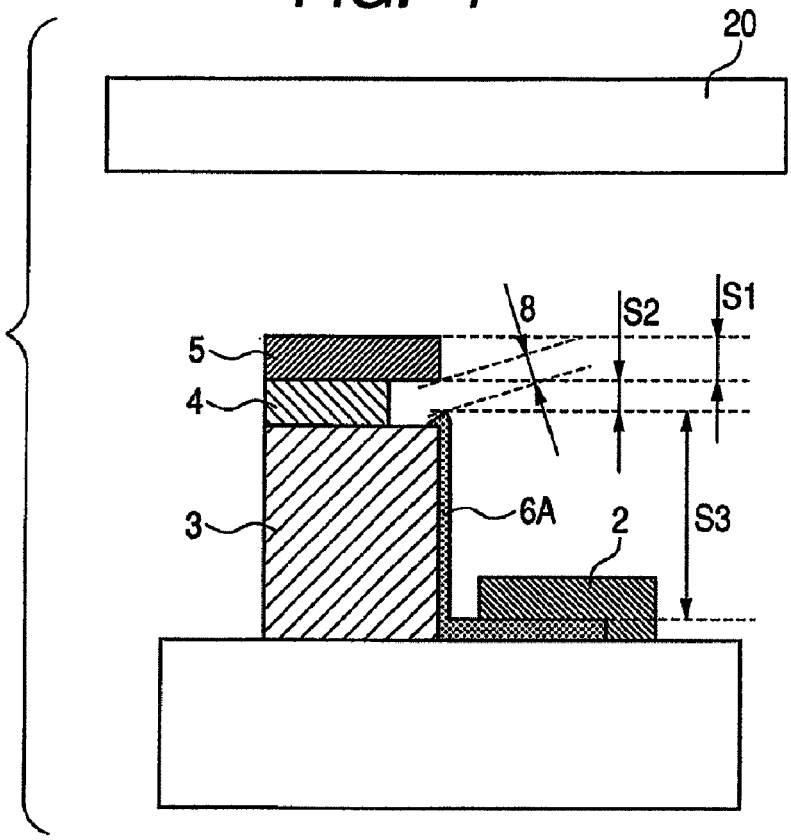
FIG. 4 is a schematic diagram illustrating the configuration of the electron-emitting device of the present invention.

The number of scattering and distance are described with reference to FIG. 4.

The electric potential region of the device includes a high electric potential region determined by a voltage applied to the gate electrode 5 and a low electric potential region determined by a voltage applied to the electrode 2 and the cathode 6A connected to the electrode 2 with a gap 8 therebetween. Region lengths S1, S2 and S3 are determined by the electric potential of the gate and the cathode and different from mere electrode thickness and insulating-layer thickness.

The application of the voltage Vf between the gate and the cathode of the electron-emitting device according to the present invention emits electrons from the tip of the low electric potential region to the high electric potential region that the low electric potential region opposes. The electrons are isotropically scattered at the tip of the high electric potential region. Most of the electrons scattered at the tip of the high electric potential region are elastically scattered several times at the high electric potential region.

For the configuration of the present invention, the efficiency is mainly determined by the distance S1. Furthermore, the distance S1 is less than the maximum flight distance before electrons are scatter for the first time, generating electrons which are not multiply scattered.

A detailed examination of behavior of scattering reveals the following. That is, it is revealed that the efficiency of the electron-emitting device depends on the work function $\phi wk$ and the driving voltage Vf of the material used in the gate electrode, and the distances S1 and S3 of the electron-emitting device in the vicinity of the electron emission portion.

An analytical examination derives the following equation related to S1max (T1 in FIG. 3):

$$S1\max = A*\exp[B*(Vf-\phi wk)/(Vf)] \quad (3)$$

$$A=-0.78+0.87*\log(S3)$$

$$B=8.7$$

where, S1 and S3 are distances (nm in unit), $\phi wk$ is the value of work function (eV in unit) of the gate electrode (or the member connected thereto on the same electric potential) forming the high electric potential region, Vf is a driving voltage (V in unit), A is the function of S3 and B is a constant.

As described above, the distance S1 as a parameter related to scattering is important to the electron emission efficiency. Setting the distance S1 to the equation (3) shows that the efficiency can be substantially improved.

For this reason, satisfying the above equation (3) in the configuration of the invention of the present application also enables the provision of the electron-emitting device which has the above three effects (reduction of temporal variation, improvement of mechanical strength and minimization of breakdown of the device) and of which the electron emission efficiency is further improved.

In the configuration of the present invention, a space potential distribution formed by a driving voltage between the anode electrode and the electron-emitting device causes a part of emitted electrons to reach the upper portion of the gate electrode without being scattered again on the gate electrode and then directly reach the anode electrode.

Thus, the electrons that are not scattered on the gate electrode are important to the improvement of the efficiency.

A description is made below with reference to FIG. 10. The end (the protruding portion) of the cathode 6A is alienated from the gate electrode (to increase the distance D) as much as possible to reduce the scattering of electrons on the opposite face 52 of the gate electrode, thereby enabling an electron emission efficiency to be improved. In addition, increase in an offset amount Dx between the end (the protruding portion) of the cathode 6A and the end of the gate electrode when the electron-emitting device of the present invention is viewed from its side tends to increase the efficiency from the above reason.

Figure 20:
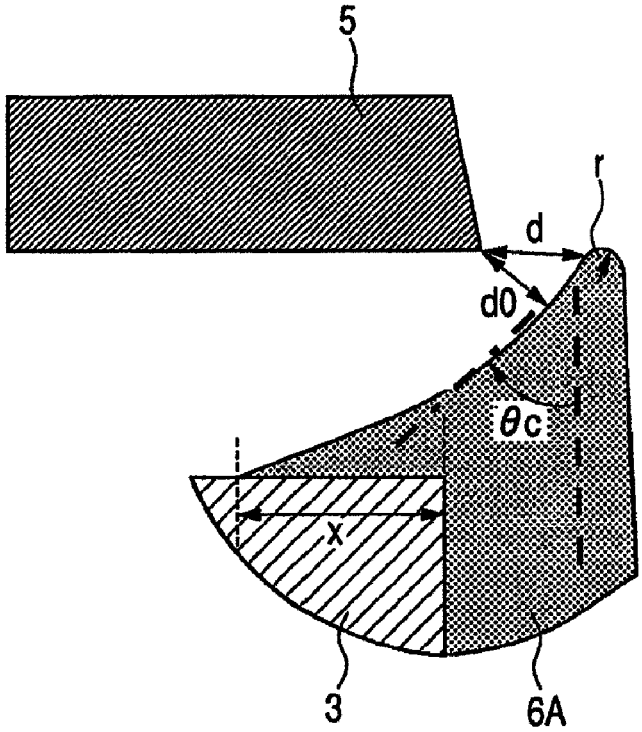
FIG. 20 is an enlarged side view in the vicinity of the electron emission portion of the electron-emitting device of the present invention.

The portion on the recess side (on the recess side of the insulating layer) of end of the cathode 6A (the protruding portion) may be slanted (particularly in the vicinity of the electron emission portion) with respect to a normal line extended from the surface of the gate electrode portion (the lower surface of the gate electrode) opposing the recess of the insulating layer, thereby forming an electric potential distribution in which electrons emitted from the tip easily jump outside the recess to increase an electron emission efficiency. FIG. 20 is a partial expansion view illustrating the above structure. In FIG. 20, for simply describing a slanting shape, the normal line extended from the surface of the gate electrode portion (the lower surface of the gate electrode) opposing the recess of the insulating layer is displaced in parallel to the tip of the protruding portion of the cathode 6.

Figure 21:
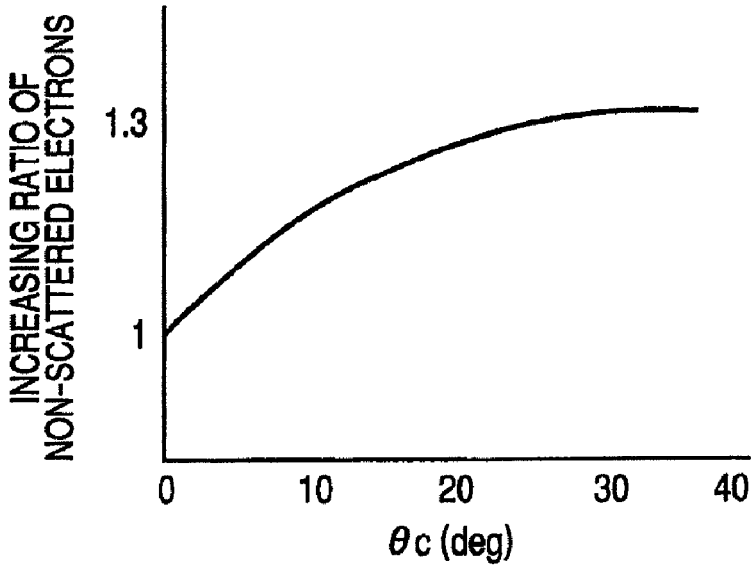
FIG. 21 is a graph illustrating a relationship between an angle of the cathode ridgeline on the recess side of the electron-emitting device and variation in characteristic of the device.

As illustrated in FIG. 20, the portion on the recess side of end of the cathode 6A (the protruding portion) is slanted with respect to the normal line extended from the surface of the gate electrode portion (the lower surface of the gate electrode) opposing the recess of the insulating layer. The analytical examination found that the ratio of non-scattered electrons was increased as the slant angle θc was increased, as illustrated in FIG. 21. In other words, as illustrated in FIG. 21, the ratio of non-scattered electrons is increased as the angle θc made by the ridgeline from the end of the cathode 6A (the tip of the protruding portion) to the part where the protruding portion is in contact with the inner surface of the recess and the normal line extended from the lower surface of the gate is increased. The angle θc of 0 degrees corresponds to the case where the protruding portion of the cathode 6A is regarded as a pole parallel to the normal line extended from the lower surface of the gate. The ordinate in FIG. 21 is normalized by the amount of non-scattered electrons at the angle θc=0 degrees.

When the offset amount Dx is increased, in the configuration of the present invention, the shortest distance d0 between the slant portion (skirt portion) of the recess side of the protruding portion of the cathode 6A and the gate electrode is sometimes smaller than the shortest distance d between the end of the cathode 6A (the tip of the protruding portion of the cathode) and the gate electrode. In this case, if an electric field strength E0 at the slant portion (skirt portion) of the protruding portion of the cathode 6A is greater than an electric field strength E at the end of the cathode 6A (the tip of the protruding portion), electrons are emitted from the slant portion (skirt portion) of the cathode 6A to increase electrons scattered on the gate electrode. Then, in order to achieve a high efficiency in such a case, the following relationship needs to be satisfied. The electric field strength E at the end of the cathode 6A (the tip of the protruding portion) is determined by $(\beta r \times 1/d)$ Vg and the electric field strength E0 at the slant portion (skirt portion) of the cathode 6A is determined by $(\beta 0 \times 1/d0)$ Vg so that E>E0 is satisfied. Where, βr is an electric field enhancement factor by the shape effect of the end of the cathode 6A (the tip of the protruding portion), β0 is an electric field enhancement factor by the shape effect of the slant portion (skirt portion) of the cathode 6A (the electric field enhancement factor is a coefficient of 1 for a completely parallel plate) and Vg is a voltage applied to the gate electrode.

For this reason, if the case where E>E0 is represented by using βr and β0, and d and do, there is obtained $(\beta r/\beta 0)>(d/d0)$. That is to say, in the configuration of the present invention, it is recommended that the tip "r" of the protruding portion is made small to increase the electric field enhancement factor βr at the end of the cathode 6A (the tip of the protruding portion).

Satisfying the abovementioned conditions increases the ratio of electrons which are not scattered at the gate electrode, further improving the efficiency.

The foregoing electron-emitting device according to the embodiment of the present invention is described further in detail below.

An example of a method of producing the electron-emitting device according to the embodiment of the present invention is described with reference to FIGS. 11 and 12. FIGS. 11 and 12 are schematic diagrams illustrating stepwise a production process for the electron-emitting device according to the embodiment of the present invention.

A substrate 1 is one for mechanically supporting the device and made of quartz glass, glass the impurity content of which is reduced such as Na, soda lime glass and silicon. It is desirable that as functions required for the substrate, the substrate material is not only high in mechanical strength, but also resistant to alkali such as dry etching liquid, wet etching liquid and developer and to acid and small in difference in thermal expansion between the substrate and a film-forming material or other stack members if it is used as an integral unit such as a display panel. Furthermore, such a substrate material is desirable that alkali element is hardly diffused from the inside of glass due to heat treatment.

Figure 11A:
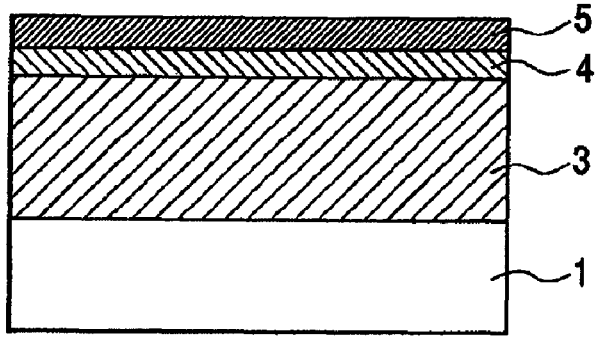
FIGS. 11A, 11B and 11C are a set of schematic diagrams illustrating a method of producing the electron-emitting device of the present invention.

First of all, as illustrated in FIG. 11A, the insulating layers 3 and 4 are stacked on the substrate and then the gate electrode 5 is stacked on the insulating member (the insulating layer 4) to form a step on the substrate.

The insulating layer 3 is an insulating film made of a material excellent in workability, such as SiN ($Si_xN_y$) or $SiO_2$, for example. The insulating layer 3 is produced by a general vacuum deposition method such as a sputtering method, CVD method or vacuum deposition method. The thickness of the insulating layer 3 is set to several nm to several tens μm and preferably several tens nm to several hundreds nm.

The insulating layer 4 is an insulating film made of a material excellent in workability, such as SiN ($Si_xN_y$) or $SiO_2$, for example. The film is produced by a general vacuum deposition method such as, for example, a CVD method, vacuum deposition method or sputtering method. The thickness of the film is set to several nm to several hundreds nm and desirably several nm to several tens nm. Since the recess needs to be formed after the insulating layers 3 and 4 are stacked, the insulating layers 3 and 4 need to be set to such a relationship as to provide the insulating layers 3 and 4 with a different etching amount respectively in etching. The ratio of an etching amount between the insulating layers 3 and 4 is desirably 10 or more, or 50 or more if possible.

The insulating layer 3 may use $Si_xN_y$, for example. The insulating layer 4 may be formed of, for example, an insulating material such as $SiO_2$, PSG high in phosphorus concentration or BSG film high in boron concentration.

The gate electrode 5 is conductive and formed by a general vacuum deposition method such as a vapor deposition method and sputtering method.

A material which is conductive and high in thermal conductivity and melting point is desirable for the gate electrode 5. There may be used metals such as, for example, Be, Mg, Ti, Zr, Hf, V, Nb, Ta, Mo, W, Al, Cu, Ni, Cr, Au, Pt and Pd or alloy material. Furthermore, there may be used carbide such as TiC, ZrC, HfC, TaC, SiC and WC, boride such as $HfB_2$, $ZrB_2$, $CeB_6$, $YB_4$ and $GdB_4$, nitride such as TiN, ZrN, HfN and TaN and a semiconductor such as Si and Ge. Still furthermore, there may be properly used an organic polymer material, amorphous carbon, graphite, diamond-like carbon, carbon in which diamond is dispersed and a carbon compound.

The thickness of the gate electrode 5 is set to several nm to several hundreds nm and desirably several tens nm to several hundreds nm.

Figure 11B:
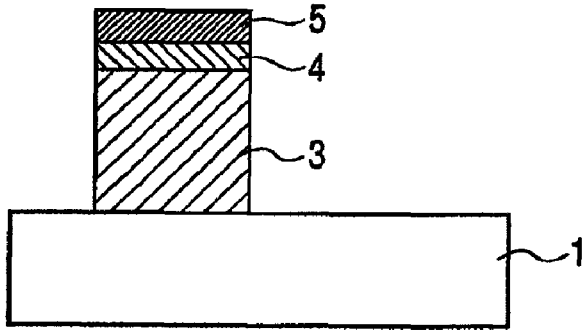

As illustrated in FIG. 11B, a resist pattern is formed on the gate electrode by a photolithography technique and then the gate electrode 5, the insulating layer 4 and the insulating layer 3 are processed in this order by an etching method.

In such an etching process, there is generally used reactive ion etching (RIE) capable of precisely etching a material by irradiating the material with plasmatized etching gas.

As processing gas in this case, there is selected fluoric gas such as $CF_4$, $CHF_3$ and $SF_6$ if fluoride is produced as a member to be processed. Furthermore, there is selected chloric gas such as $Cl_2$, and $BCl_3$ if chloride such as Si and Al is produced. Still furthermore, hydrogen, oxygen or argon gas is added as needed in order to gain a selection ratio with respect to the resist, secure smoothness on the etching surface or increase an etching speed.

Figure 11C:
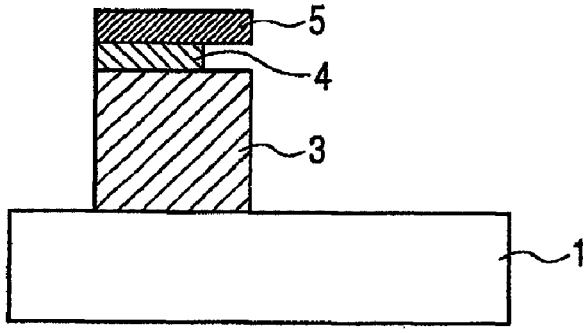

As illustrated in FIG. 11C, the insulating layer 4 is etched by the etching method to form the recess on the surface of the insulating member of the insulating layers 3 and 4.

For the etching, there may be used mixed solution of ammonium fluoride commonly known as buffer hydrofluoric acid (BHF) and hydrofluoric acid if the insulating layer 4 is made of $SiO_2$, for example. There may be used a thermal phosphoric acid etching solution if the insulating layer 4 is made of $Si_xN_y$.

The depth of the recess (a distance between the outer surface of the insulating member (the side of the insulating layer 3) and the side of the insulating layer 4) is intimately related with a leak current after the device is formed. The deeper the recess, the smaller the leak current. An excessively deep recess causes a problem in that the gate electrode is deformed. For this reason, the depth is formed on the order of 30 nm to 200 nm.

Figure 12A:
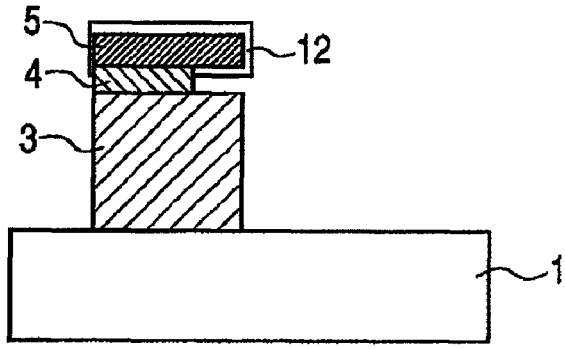
FIGS. 12A, 12B, 12C and 12D are another set of schematic diagrams illustrating a method of producing the electron-emitting device of the present invention.

As illustrated in FIG. 12A, a separating layer 12 is formed on the gate electrode 5.

The separating layer is formed to separate a conductive material deposited at the following step from the gate electrode. For such a purpose, the separating layer 12 is formed such that, for example, the gate electrode is oxidized to form an oxide film or a separating metal is caused to adhere to the separating layer by electrolytic plating.

Figure 12B:
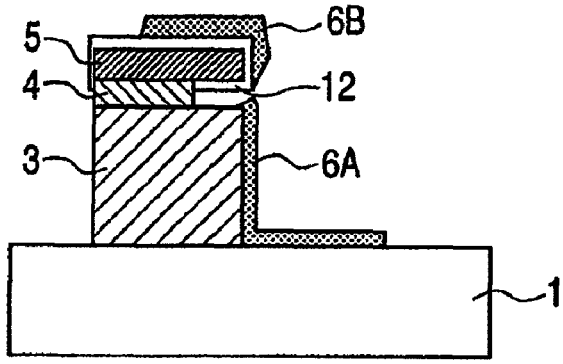

As illustrated in FIG. 12B, a cathode material 6B is caused to adhere onto the gate electrode and the cathode 6A is caused to adhere onto a part of outer surface of the insulating member (the outer surface (side) of the insulating layer 3) and the inner surface of the recess (the upper surface of the insulating layer 3).

The cathode material may be conductive, be a material for emitting electrons, high in melting point of generally 2000° C. or higher, may have a work function of 5 eV or less and is immune to the formation of a chemical reaction layer such as an oxide or desirably may be a material from which a reaction layer can be easily removed. As such a material, there may be used metals such as, for example, Hf, V, Nb, Ta, Mo, W, Au, Pt and Pd or alloy material. Furthermore, there may be used carbide such as TiC, ZrC, HfC, TaC, SiC and WC, boride such as $HfB_2$, $ZrB_2$, $CeB_6$, $YB_4$ and $GdB_4$ and nitride such as TiN, ZrN, HfN and TaN. Still furthermore, there may be properly used amorphous carbon, graphite, diamond-like carbon, carbon in which diamond is dispersed and a carbon compound.

The conductive layer is formed by a general vacuum deposition method such as a vapor deposition method and sputtering method.

As described above, in the present invention, the protruding portion of the cathode needs to be formed to an optimum shape by controlling angle and film-formation time in vapor deposition and temperature and degree of vacuum at the time of formation to effectively emit electrons. Specifically, an amount "x" of entrance of the cathode material into the upper surface of the insulating layer 3 being the inner surface of the recess may be 10 nm to 30 nm, more desirably 20 nm to 30 nm. An angle made by the upper surface of the insulating layer 3 being the inner surface of the recess of the insulating member and the cathode may be 90° C. or more.

Figure 12C:
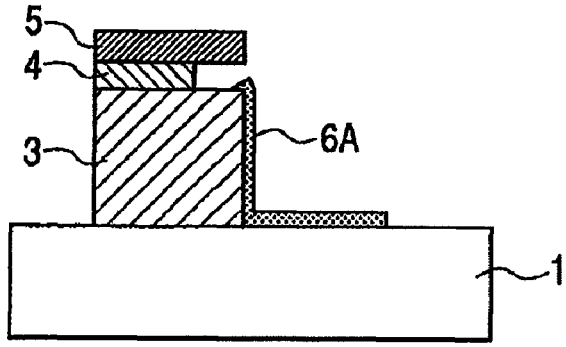

As illustrated in FIG. 12C, the separating layer is removed by etching to remove the cathode material 6B (the material for the emission portion) on the gate electrode. An electrode 2 is formed to be electrically conductive to the cathode 6A.

The electrode 2 is conductive similarly to the cathode 6A and formed by a general vacuum deposition method such as a vapor deposition method and sputtering method and the photolithography technique.

The electrode 2 may use metals such as, for example, Be, Mg, Ti, Zr, Hf, V, Nb, Ta, Mo, W, Al, Cu, Ni, Cr, Au, Pt and Pd or alloy material. Furthermore, there may be used carbide such as TiC, ZrC, HfC, TaC, SiC and WC, boride such as $HfB_2$, $ZrB_2$, $CeB_6$, $YB_4$ and $GdB_4$ and nitride such as TiN, ZrN and HfN. Still furthermore, there may be used a semiconductor such as Si and Ge, an organic polymer material, amorphous carbon, graphite, diamond-like carbon, carbon in which diamond is dispersed and a carbon compound.

The thickness of the electrode 2 is set to several tens nm to several mm and desirably several tens nm to several μm.

The electrode 2 and the gate electrode 5 may be the same material or different materials and may be formed by the same method or different methods. The gate electrode 5 is desirably made of a material low in resistance because the film thickness of the gate electrode 5 is sometimes set thinner than that of the electrode 2.

An image display apparatus equipped with an electron source including a plurality of the electron-emitting devices according to the embodiment of the present invention is described below with reference to FIGS. 7, 8 and 9.

Figure 7:
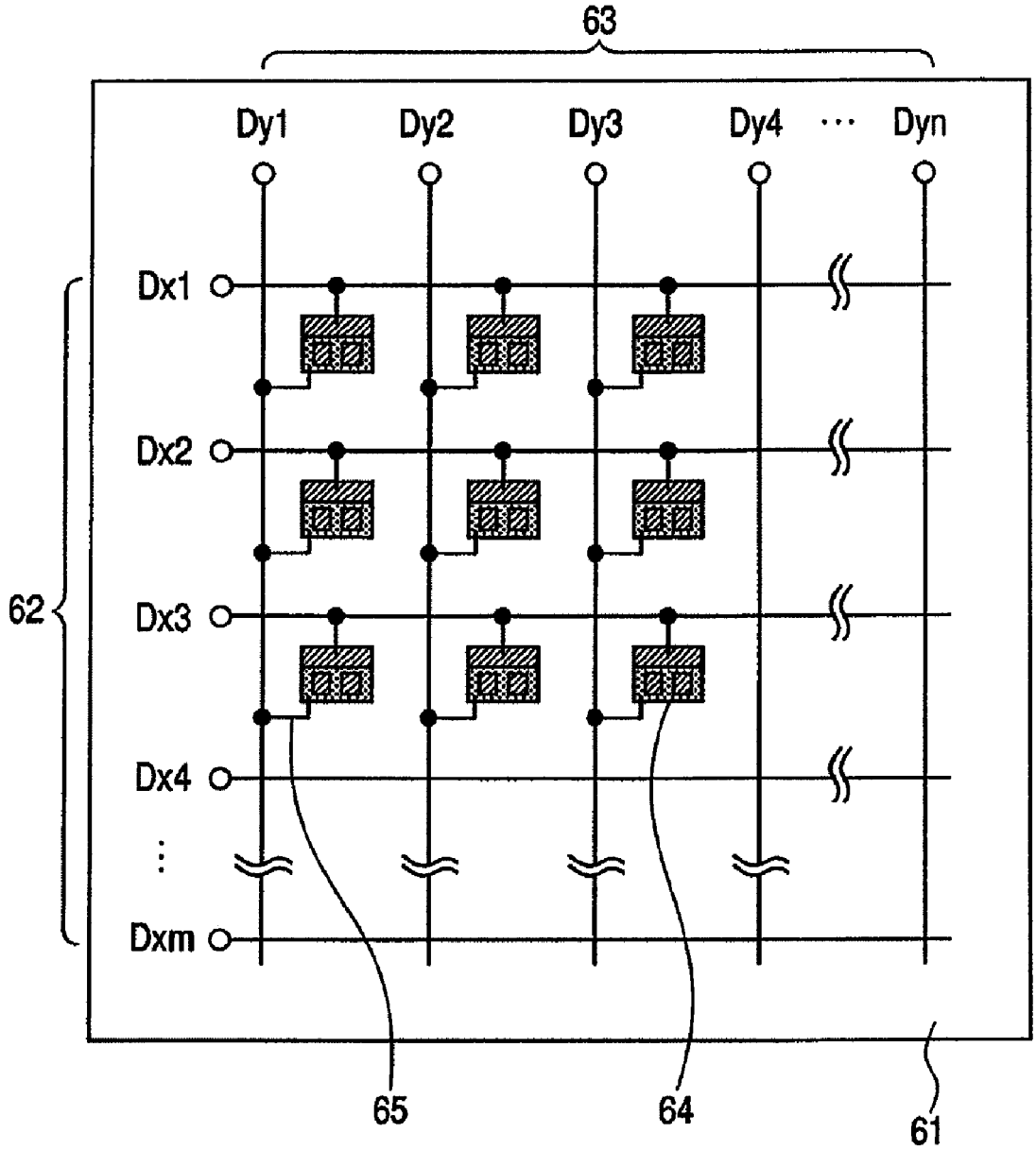
FIG. 7 is a schematic diagram illustrating an electron source of the image display apparatus applying the electron-emitting device of the present invention.

In FIG. 7, there are provided an electron-source substrate 61, X-direction wiring 62, Y-direction wiring 63, electron-emitting device 64 according to the embodiment of the present invention and connection 65. Incidentally, the X-direction wiring commonly connects the aforementioned (cathode) electrodes 2 to each other and the Y-direction wiring commonly connects the aforementioned gate electrodes 5 to each other.

M X-direction wirings 62 are formed of DX1, DX2, . . . DXm and can be configured by conductive metal formed using a vacuum deposition method, printing method and sputtering method. The material, film thickness and width of the wiring are properly designed.

The Y-direction wiring 63 is formed of n wirings DY1, DY2, . . . DYn and formed similarly to the X-direction wiring 62. An interlayer insulating layer (not shown) is provided between the m X-direction wirings 62 and the n Y-direction wirings 63 to electrically separate from each other (m and n are a positive integer).

The interlayer insulating layer (not shown) is formed of $SiO_2$ using a vacuum deposition method, printing method and sputtering method. The interlayer insulating layer in a desired shape, for example, is formed on the whole or partial surface of the electron-source substrate 61 on which the X-direction wirings 62 are formed. The film thickness of, the material and production method for the interlayer insulating layer are properly set so that the interlayer insulating layer can resist particularly an electric potential difference on the intersections between the X-direction wiring 62 and the Y-direction wiring 63. The X-direction wiring 62 and the Y-direction wiring 63 are drawn as external terminals.

The cathode and the gate (not shown) forming the electron-emitting device 64 of the present invention are electrically connected together by the m X-direction wirings 62, the n Y-direction wirings 63 and the connection 65 of conductive metal.

Materials forming the wirings 62 and 63, the connection 65, the cathode and the gate may be the same or different in the whole or a part of the constituent element thereof.

The X-direction wiring 62 is connected to a scanning signal applying unit (not shown) which applies a scanning signal for selecting the row of the electron-emitting devices 64 arranged in the X direction. On the other hand, the Y-direction wiring 63 is connected to a modulation signal generating unit (not shown) which modulates the electron-emitting devices 64 arranged in each column in the Y direction according to an input signal.

The driving voltage applied to the electron-emitting device is applied thereto as a difference voltage between the scanning signal and the modulation signal applied to the device.

In the above configuration, an individual device is selected using a simple matrix wiring to enable the device to be independently driven.

The image display apparatus formed by using such an electron source with a simple matrix arrangement is described below with reference to FIG. 8. FIG. 8 is a schematic diagram illustrating an example of a display panel for the image display apparatus.

Figure 8:
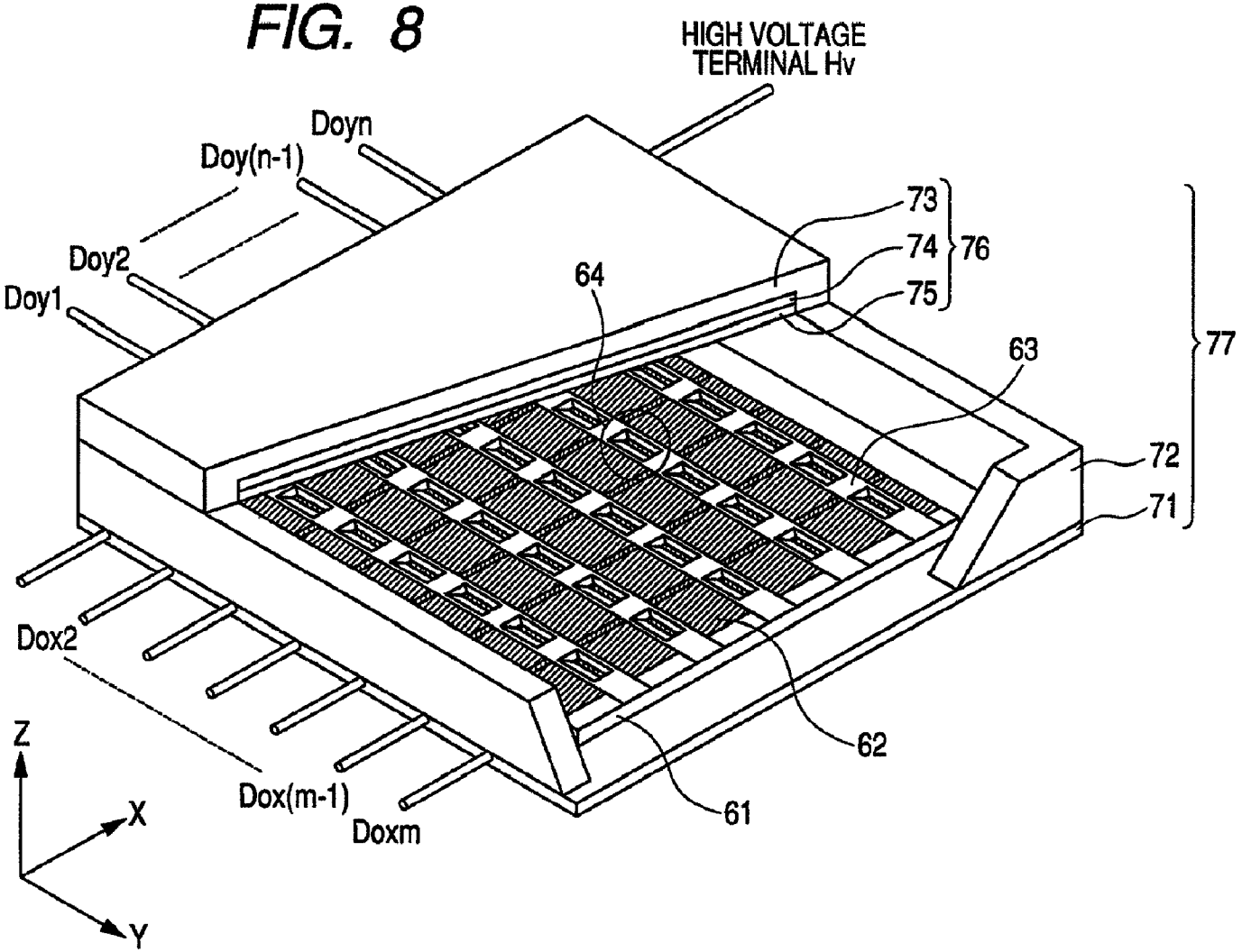
FIG. 8 is a schematic diagram illustrating the image display apparatus applying the electron-emitting device of the present invention.

In FIG. 8, a plurality of the electron-emitting devices are arranged on the electron-source substrate 61 and a rear plate 71 fixes the electron-source substrate 61. A face plate 76 forms a metal back 75 being a third conductive member and a phosphor film 74 as a light emitting member positioned on the third conductive member on the inner surface of a glass substrate 73.

A supporting frame 72 is connected to the rear plate 71 and the face plate 76 using frit glass. An envelope 77 is baked, for example, in the air or in an atmosphere of nitrogen at temperatures of 400° C. to 500° C. for ten minutes or longer to be sealed.

The electron-emitting device 64 corresponds to that in illustrated in FIGS. 1A, 1B and 1C. The X-direction wiring 62 and the Y-direction wiring 63 are connected to the (cathode) electrode 2 and the gate electrode 5 of the electron-emitting device respectively.

As described above, the envelope 77 is formed of the face plate 76, the supporting frame 72 and the rear plate 71. The rear plate 71 is provided mainly for reinforcing the strength of the substrate 61, so that the separate rear plate 71 may be eliminated if the substrate 61 itself has a sufficient strength.

That is to say, the substrate 61 may be directly sealed in the supporting frame 72 to form the envelope 77 with the face plate 76, the supporting frame 72 and the substrate 61. On the other hand, a support (not shown) referred to as a spacer may be interposed between the face plate 76 and the rear plate 71 to form the envelope 77 strong enough to withstand the atmospheric pressure.

In the image display apparatus using the electron-emitting device according to the embodiment of the present invention, phosphors are aligned on the upper portion of the device in consideration of the orbit of emitted electrons.

Figure 19A:
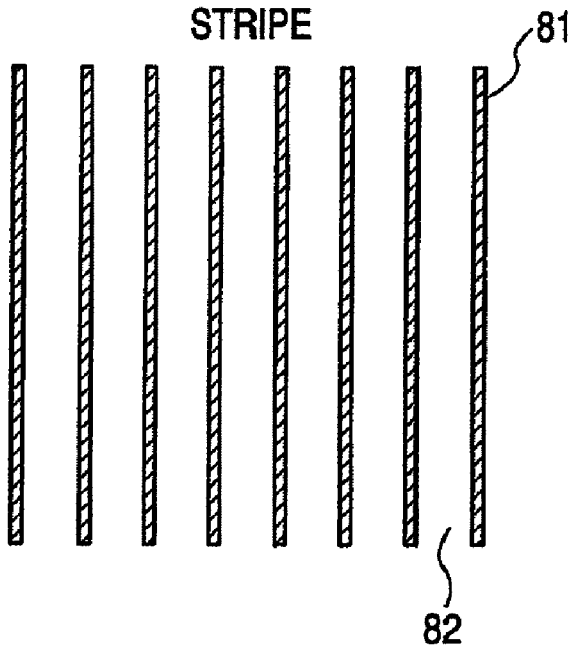
FIGS. 19A and 19B are diagrams illustrating the face plate of the image display apparatus.
Figure 19B:
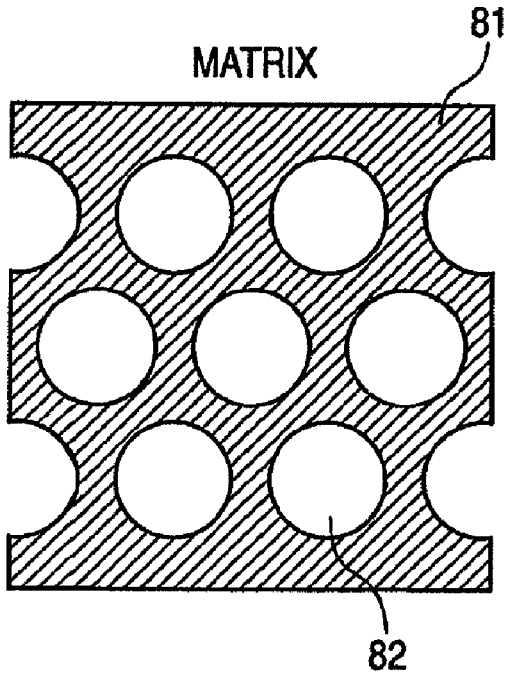

FIGS. 19A and 19B are schematic diagrams illustrating the phosphor film being the light emitting member used in the panel. A color phosphor film may be formed of a black conductive material 81 and a phosphor 82 which are referred to as a black stripe illustrated in FIG. 19A and a black matrix illustrated in FIG. 19B depending on the arrangement of the phosphors.

Figure 9:
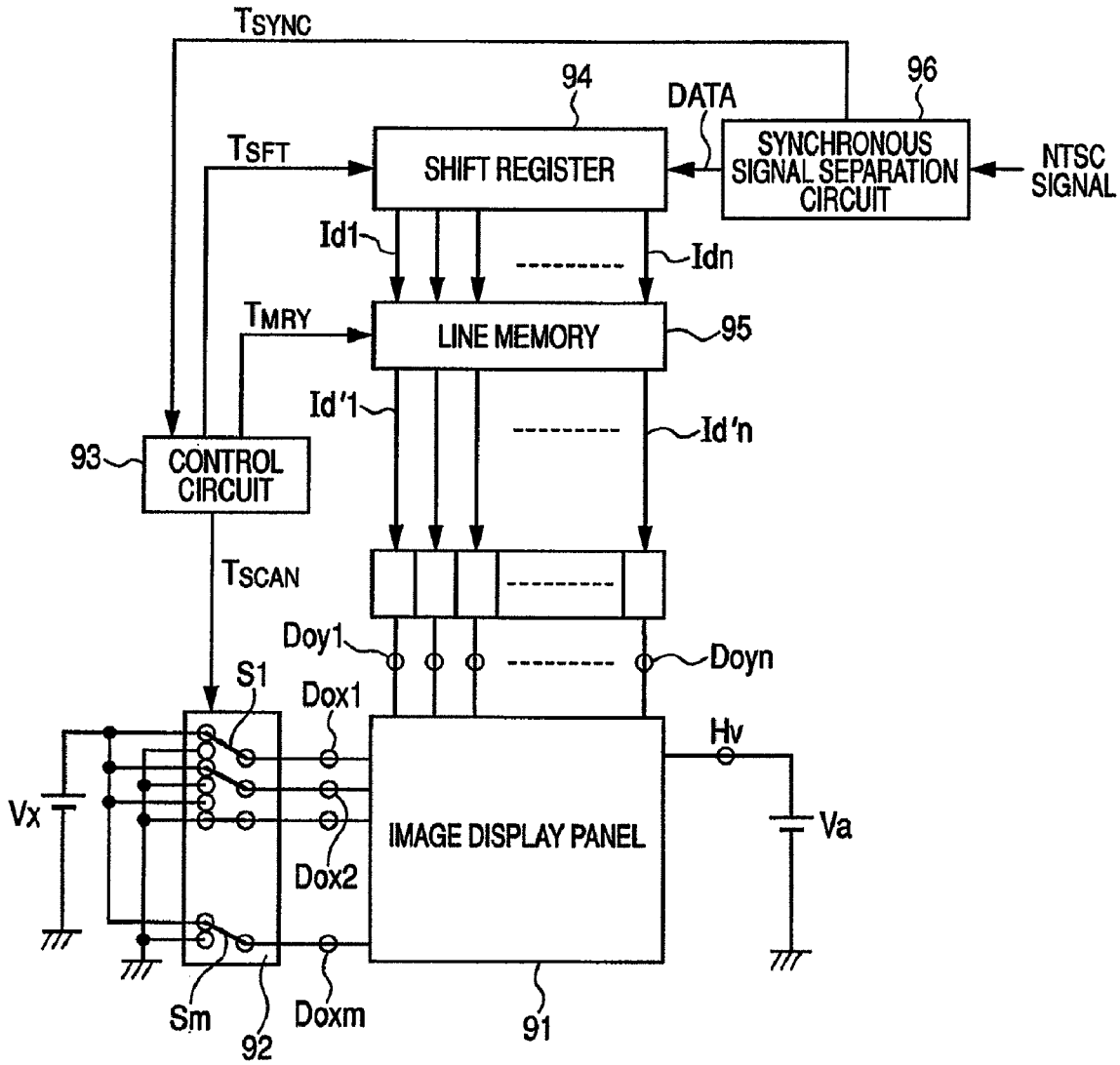
FIG. 9 is a circuit diagram illustrating an example of a driving circuit for driving the image display apparatus of the present invention.

Referring to FIG. 9, there is described below an example of configuration of a driving circuit for displaying television based on the NTSC television signal on a display panel formed using the electron source with a simple matrix arrangement.

In FIG. 9, there are provided an image display panel 91, scanning circuit 92, control circuit 93, shift reregister 94, line memory 95, synchronous signal separation circuit 96, modulation signal generator 97 and DC voltage sources Vx and Va.

The display panel 91 is connected to an external electric circuit through terminals Dox1 to Doxm, terminals Doy1 to Doyn and a high voltage terminal Hv.

A scanning signal for sequentially driving the electron source provided in the display panel, i.e., the electron-emitting devices wired in a matrix form with M rows and N columns on a row (N devices) basis is applied to the terminals Dox1 to Doxm.

On the other hand, a modulation signal for controlling electron beams output from one row of the electron-emitting devices selected by the scanning signal is applied to the terminals Doy1 to Doyn.

The high voltage terminal Hv is supplied with a DC voltage of 10 kV, for example, by the DC voltage source Va. The DC voltage is an accelerating voltage for providing electron beams emitted from the electron-emitting devices with energy enough to excite the phosphor.

As described above, the application of the scanning signal and the modulation signal and that of the high voltage to the anode accelerate the emitted electrons to irradiate the phosphor with the electrons, thereby realizing image display.

The formation of such a display apparatus using the electron-emitting device of the present invention enables forming the display apparatus in which an electron beam is refined in shape, thereby enabling providing the image display apparatus excellent in display characteristic.

First Embodiment

FIG. 1A is a plan schematic diagram of the electron-emitting device according to the embodiment of the present invention. FIG. 1B is a cross section taken along the line A-A of FIG. 1A. FIG. 1C is a side view when the device is viewed from the direction indicated by the arrow in FIG. 1B.

In FIGS. 1A, 1B and 1C, insulating layers 3 and 4 form an insulating member. In the present embodiment, the member forms a step on the surface of a substrate 1. A gate electrode 5 is positioned on the insulating member. A cathode 6A is formed of a conductive material, electrically connected to an electrode 2, positioned on the outer surface of the insulating layer 3 being a part of the insulating member forming a step and has a protruding portion serving as an electron emission portion. A recess portion (recess) 7 is formed such that the side of the insulating layer 4 is retracted inside to be concaved with respect to the side (the outer surface) of the insulating layer 3 and the side of the gate electrode 5. Although not illustrated in FIGS. 1A, 1B and 1C, over the cathode 6A and the gate electrode 5 there is provided an anode electrode which is fixed to an electric potential higher than the electric potential applied to the above components and positioned in opposition thereto (refer to reference numeral 20 in FIG. 2). A gap 8 between which an electric field required for emitting electrons is formed represents the shortest distance between the tip of protruding portion of the cathode 6A and the bottom surface (the portion opposing the recess) of the gate electrode 5. FIG. 3 is a bird's eye enlarged view in the vicinity of the emission portion of the device in FIGS. 1A, 1B and 1C.

An example of a method of producing the electron-emitting device according to the embodiment of the present invention is described below with reference to FIGS. 11 and 12. FIGS. 11 and 12 are schematic diagrams illustrating stepwise a production process for the electron-emitting device according to the embodiment of the present invention.

A substrate 1 is one for mechanically supporting the device and uses PD200 being low sodium glass developed for a plasma display in the present embodiment.

First of all, as illustrated in FIG. 11A, the insulating layers 3 and 4 and the gate electrode 5 are stacked on the substrate 1.

The insulating layer 3 is an insulating film made of a material excellent in workability. An SiN ($Si_2N_y$) film was formed by the sputtering method and was 500 nm in thickness.

The insulating layer 4 is made of $SiO_2$ being an insulating film formed of a material excellent in workability. The film was produced by sputtering method and was 30 nm in thickness.

The gate electrode 5 is made of a TaN film. The film was formed by the sputtering method and was 30 nm in thickness.

As illustrated in FIG. 11B, a resist pattern is formed on the gate electrode by a photolithography technique and then the gate electrode 5, the insulating layer 4 and the insulating layer 3 are processed in this order by a dry etching method.

As processing gas in this case, there was used $CF_4$ gas because the insulating layers 3 and 4 and the gate electrode 5 are materials which yields fluoride as described above. Performing RIE using the gas formed an angle of approximately 80 degrees with respect to the horizontal surface of the substrate after the insulating layers 3 and 4 and the gate material 5 were etched.

After the resist was removed, as illustrated in FIG. 11C, the insulating layer 4 was etched by the etching method using BHF to form an approximately 70 nm deep recess in the insulating member of the insulating layers 3 and 4.

As illustrated in FIG. 12A, the separating layer 12 is formed on the gate electrode 5.

The separating layer 12 was formed such that the TaN gate electrode was caused to electrolytically deposit Ni by electrolytic plating.

As illustrated in FIG. 12B, molybdenum (Mo) of a cathode material was caused to adhere onto the outer surface of the insulating member and the inner surface of the recess (the upper surface of the insulating layer 3) to form the cathode 6A. Incidentally, at this point, the cathode material (6B) was caused to adhere also onto the gate electrode. In the embodiment, an EB vapor deposition method was used as a film formation method. In the formation method, the angle of the substrate was set to 60 degrees with respect to the horizontal surface of the substrate so that the cathode material (cathode film) enters the recess by approximately 35 nm. Thereby, Mo was injected onto the gate at 60 degrees and onto the RIE processed outer surface of the insulating layer 3 being a part of the insulating material forming the step at 40 degrees. A vapor deposition rate was set to approximately 12 nm/min. A vapor deposition time was precisely controlled (2.5 minutes in the example) so that the Mo on the outer surface of the insulating member was nm in thickness, an amount (x) of the cathode film entering the recess was 35 nm and an angle made by the inner surface of the recess (the upper surface of the insulating layer 3) and the protruding portion of the cathode being the electron emission portion was 120 degrees.

The separating layer of Ni deposited on the gate electrode 5 was removed using etching liquid made of iodine and potassium iodide after the Mo film was formed, thereby separating the Mo material 6B on the gate electrode from the gate.

After the separation, a resist pattern was formed by the photolithography technique so that the width T4 (FIG. 3) of the cathode 6A can be 100 μm.

Thereafter, the cathode 6A of molybdenum was processed using the dry etching method. As processing gas in this case, there was used $CF_4$ gas because the molybdenum used as the conductive material is a material yielding fluoride (refer to FIG. 12C). Thereby, the strip-shaped cathode 6A was formed which has the protruding portion positioned along the edge of the recess of the insulating member. In the present embodiment, the width of the cathode 6A coincides with that of the protruding portion and the width T4 also means the width of the protruding portion. Incidentally, the width of the protruding portion means a length of the protruding portion in the direction along the edge of the recess of the insulating member.

A cross-section TEM analysis showed that the shortest distance 8 was 9 nm between the protruding portion of the cathode being the emission portion and the gate in FIGS. 1A, 1B and 1C.

Figure 12D:
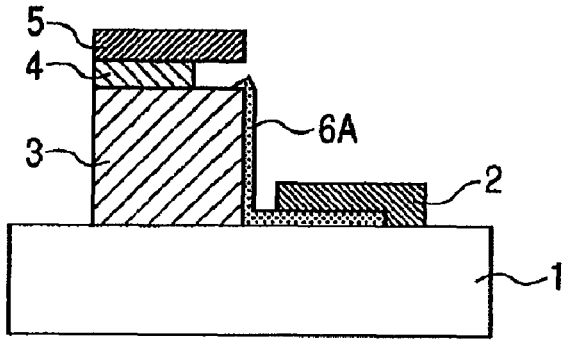

As illustrated FIG. 12D, the electrode 2 was formed. Copper (Cu) was used for the electrode 2. The electrode 2 was formed by the sputtering method and was 500 nm in thickness.

After the electron-emitting device was formed by the above method, the characteristic of the electron source was evaluated with the configuration illustrated in FIG. 2.

FIG. 2 illustrates an arrangement of a power supply in measuring the electron emission characteristic of the device of the present invention. Where, a voltage Vf is applied between the gate electrode 5 and the electrode 2, a device current If flows at this point, a voltage Va is applied between the electrode 2 and the anode 20 and an electron emission current Ie flows.

As a result of evaluation of characteristic of the configuration, the electric potential of the gate electrode 5 was taken as 26 V and the electric potential of the cathode 6A was fixed to 0 V through the electrode 2, thereby a driving voltage of 26 V was applied between the gate electrode and the cathode 6A. As a result, there was obtained the electron-emitting device with an average electron emission current Ie of 1.5 μA and an average efficiency of 17%.

Figure 10:
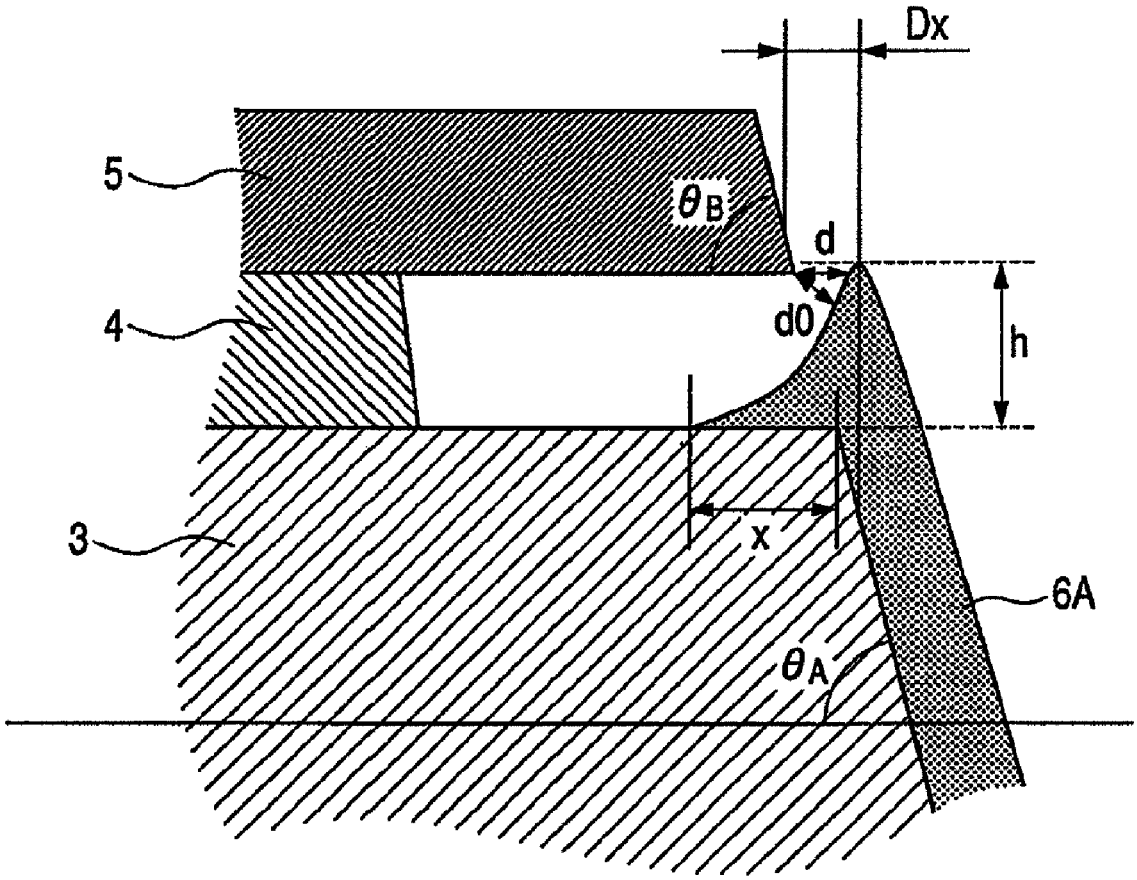
FIG. 10 is an enlarged side view in the vicinity of the electron emission portion of another electron-emitting device of the present invention.

A cross-section TEM observation of the cathode portion of the device showed the configuration illustrated in FIG. 10. In FIG. 10, the following parameters were extracted; θA=75°, θB=80°, x=35 nm, h=29 nm, Dx=11 nm and d=9 nm. An angle made by the inner surface of the recess (the upper surface of the insulating layer 3) and the protruding portion of the cathode being the electron emission portion was 125 degrees. As illustrated in the configuration, the protruding portion of the cathode being the electron emission portion is caused to enter the recess to bring the protruding portion of the conductive layer into contact with the inner surface of the recess. This improves a thermal and mechanical stability to realize an excellent electron-emitting device which is as small as approximately 3% in variation (reduction) of the current Ie and stably operates even if the device is continuously driven. As illustrated in the configuration (FIG. 10), the portion on the recess side of the protruding portion of the cathode is slanted (particularly in the vicinity of the electron emission portion) with respect to a normal line extended from the surface of the gate electrode portion (the lower surface of the gate electrode) opposing the recess of the insulating layer, thereby forming an electric potential distribution in which electrons emitted from the tip easily jump outside the recess to increase an electron emission efficiency.

Second Embodiment

Figure 13A:
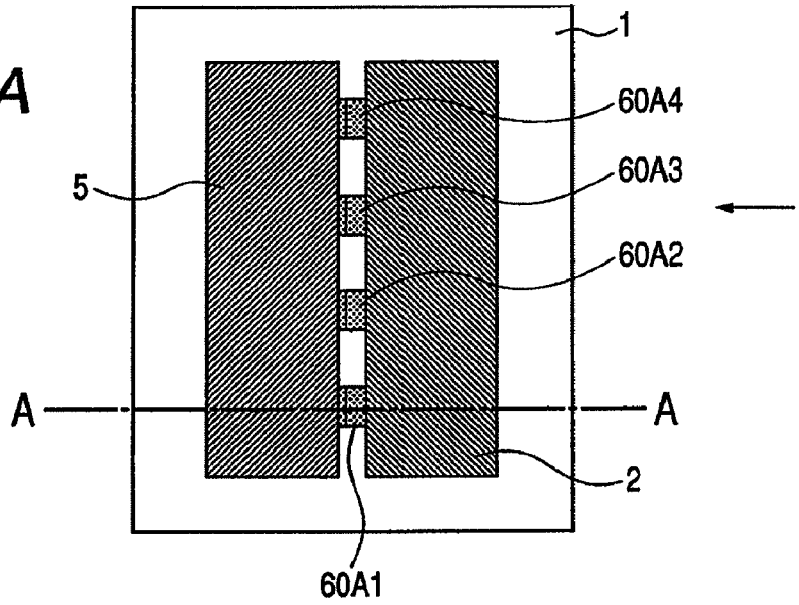
FIGS. 13A, 13B and 13C are a set of schematic diagrams illustrating the electron-emitting device of a second embodiment.
Figure 13B:
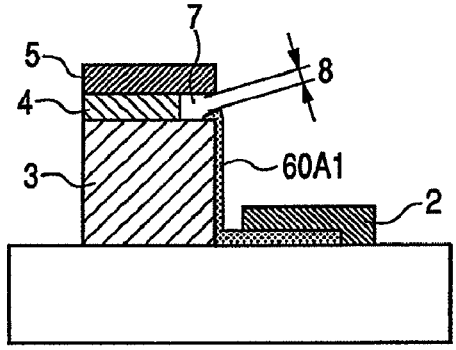
Figure 13C:
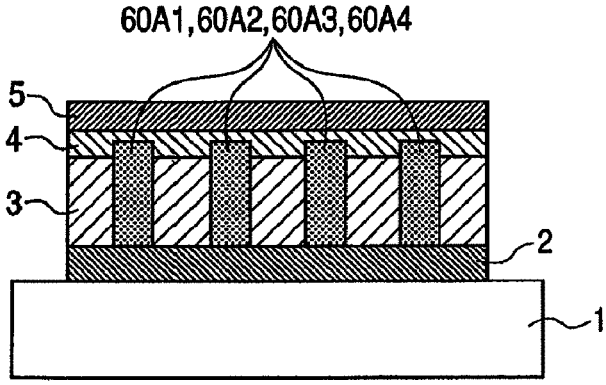

FIG. 13A is a plan schematic diagram of the electron-emitting device according to the embodiment of the present invention. FIG. 13B is a cross section taken along the line A-A of FIG. 13A. FIG. 13C is a side view when the device is viewed from the direction indicated by the arrow in FIG. 13A.

In FIGS. 13A, 13B and 13C, insulating layers 3 and 4 form an insulating member and forms a step on the surface of the substrate 1. The gate electrode 5 is positioned on the outer surface of the insulating member (the upper surface of the insulating layer 4). Strip-shaped cathodes 60A1 to 60A4 are electrically connected to the electrode 2 and provided on the outer surface of the insulating layer 3 being a part of the insulating member forming the step. The recess portion 7 is formed such that the side of the insulating layer 4 is retracted inside to be concaved with respect to the outer surface (side) of the insulating layer 3 being a part of the insulating member and the side of the gate electrode 5. Although not illustrated in FIGS. 13A, 13B and 13C, over the cathodes 60A1 to 60A4 and the gate electrode 5 there is provided the anode electrode which is fixed to an electric potential higher than the electric potential applied to the above components and positioned in opposition thereto (refer to reference numeral 20 in FIG. 2). The gap 8 between which an electric field required for emitting electrons is formed represents the shortest distance between the tip of protruding portion of the cathodes 60A1 to 60A4 and the bottom surface (the portion opposing the recess) of the gate electrode 5.

Since the production method of the second embodiment is basically the same as that of the first embodiment, only the points different from the first embodiment are described below.

As illustrated as 6B in FIG. 12B, molybdenum (Mo) being the cathode material forming the electron emission portion is caused to adhere also to the gate electrode. In the present embodiment, an EB vapor deposition method was used as a film formation method. In the formation method, the angle of the substrate was set to 80 degrees. Thereby, Mo was injected onto the upper portion of the gate electrode at 80 degrees and onto the RIE processed outer surface of the insulating layer 3 being a part of the insulating material forming the step at 20 degrees. A vapor deposition rate was set to approximately 10 nm/min. A vapor deposition time of two minutes was precisely controlled so that the Mo on the outer surface of the insulating member was 20 nm in thickness, an amount of the cathode film entering the recess was 14 nm and an angle made by the inner surface of the recess (the upper surface of the insulating layer 3) and the cathode was 100 degrees.

The separating layer of Ni deposited on the gate electrode 5 was removed using etching liquid made of iodine and potassium iodide after the Mo film was formed, thereby separating the Mo material 6B adhering onto the gate from the gate.

After the separation, a resist pattern was formed by the photolithography technique so that the width T4 (FIG. 3) of the cathodes 60A1 to 60A4 can have a line-and-space of 3 μm. Thereafter, the cathodes 60A1 to 60A4 with the protruding portion serving as the electron emission portion are processed into a strip shape along the edge of the recess of the insulating member by a dry etching method. As processing gas in this case, there was used $CF_4$ gas because the molybdenum used as the conductive material forming the protruding portion serving as the electron emission portion is a material yielding fluoride.

A cross-section TEM analysis showed that the shortest distance 8 was 8.5 nm on an average between the protruding portion of the cathode and the gate in FIG. 13B.

After the electron-emitting device was formed by the above method, the characteristic of the electron source was evaluated with the configuration illustrated in FIG. 2.

As a result of evaluation of characteristic of the configuration, the electric potential of the gate electrode 5 was taken as 26 V and the electric potential of the cathodes 60A1 to 60A4 was fixed to 0 V through the electrode 2, thereby a driving voltage of 26 V was applied between the gate electrode 5 and the cathodes 60A1 to 60A4. As a result, there was provided the device with an average electron emission current Ie of 6.2 μA and an average efficiency of 17%. Also in the configuration, as is the case with the aforementioned first embodiment, the cathode film is caused to enter the recess of the insulating member forming the step to bring the cathode into contact with the inner surface of the recess. This improves a thermal and mechanical stability to realize an excellent electron-emitting device which is as small as approximately 5% in variation (reduction) of the current Ie and stably operates even if the device is continuously driven.

In the configuration of the present embodiment, one electron-emitting device includes a plurality of cathodes each having the electron emission portion and being in a strip shape, thereby an electron emission current increases according to the number of the strip-shaped cathodes.

A line-and-space of the strip-shaped cathode was taken as 0.5 μm and the number of the strip-shaped cathodes was increased to 100 times with the same production method, thereby the amount of the electron emission obtained was increased to approximately 100 times. In addition, the present invention having the electron-emitting device including a plurality of the strip-shaped conductive layers can provide an electron beam source whose electron beam is further refined in shape than in a conventional electron-emitting device. In other words, the present invention can eliminate difficulty in control of an electron beam shape because of an electron emission point being unspecific like the conventional electron-emitting device and provide the electron beam source whose electron beam is refined in shape only by controlling the layout of the strip-shaped cathodes.

Third Embodiment

Figure 14A:
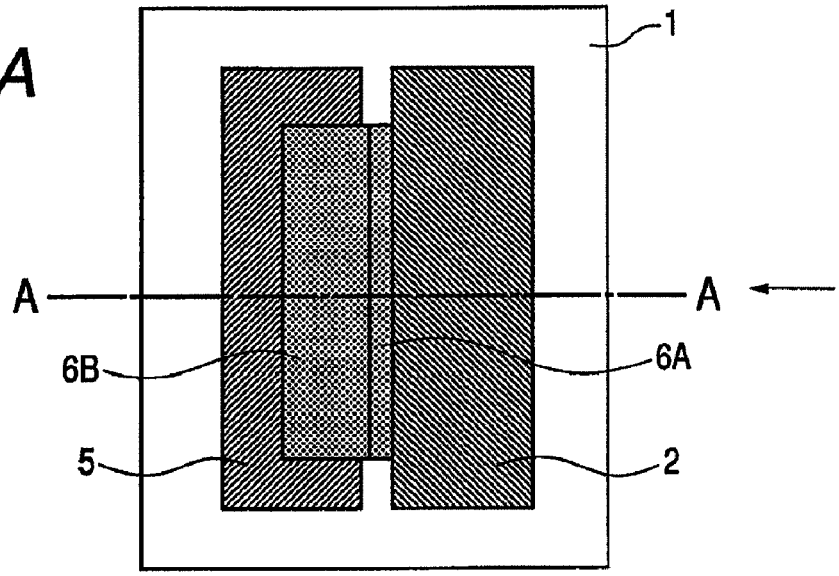
FIGS. 14A, 14B and 14C are a set of schematic diagrams illustrating the electron-emitting device of a third embodiment.
Figure 14B:
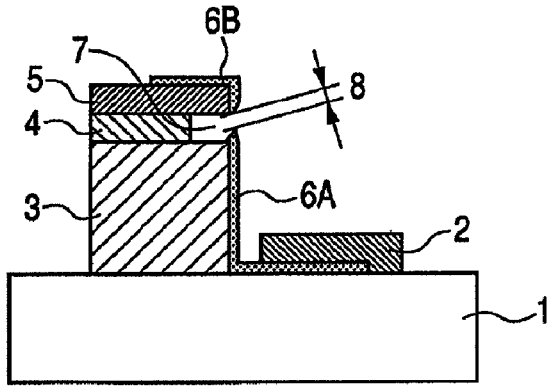
Figure 14C:
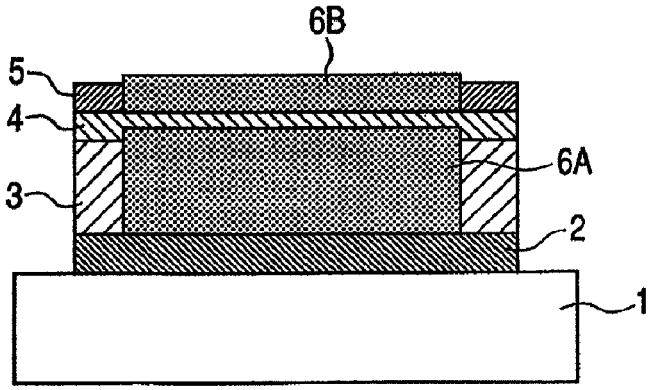

FIG. 14A is a plan schematic diagram of the electron-emitting device according to the embodiment of the present invention. FIG. 14B is a cross section taken along the line A-A of FIG. 14A. FIG. 14C is a side view when the device is viewed from the direction indicated by the arrow in FIG. 14A.

Figure 15:
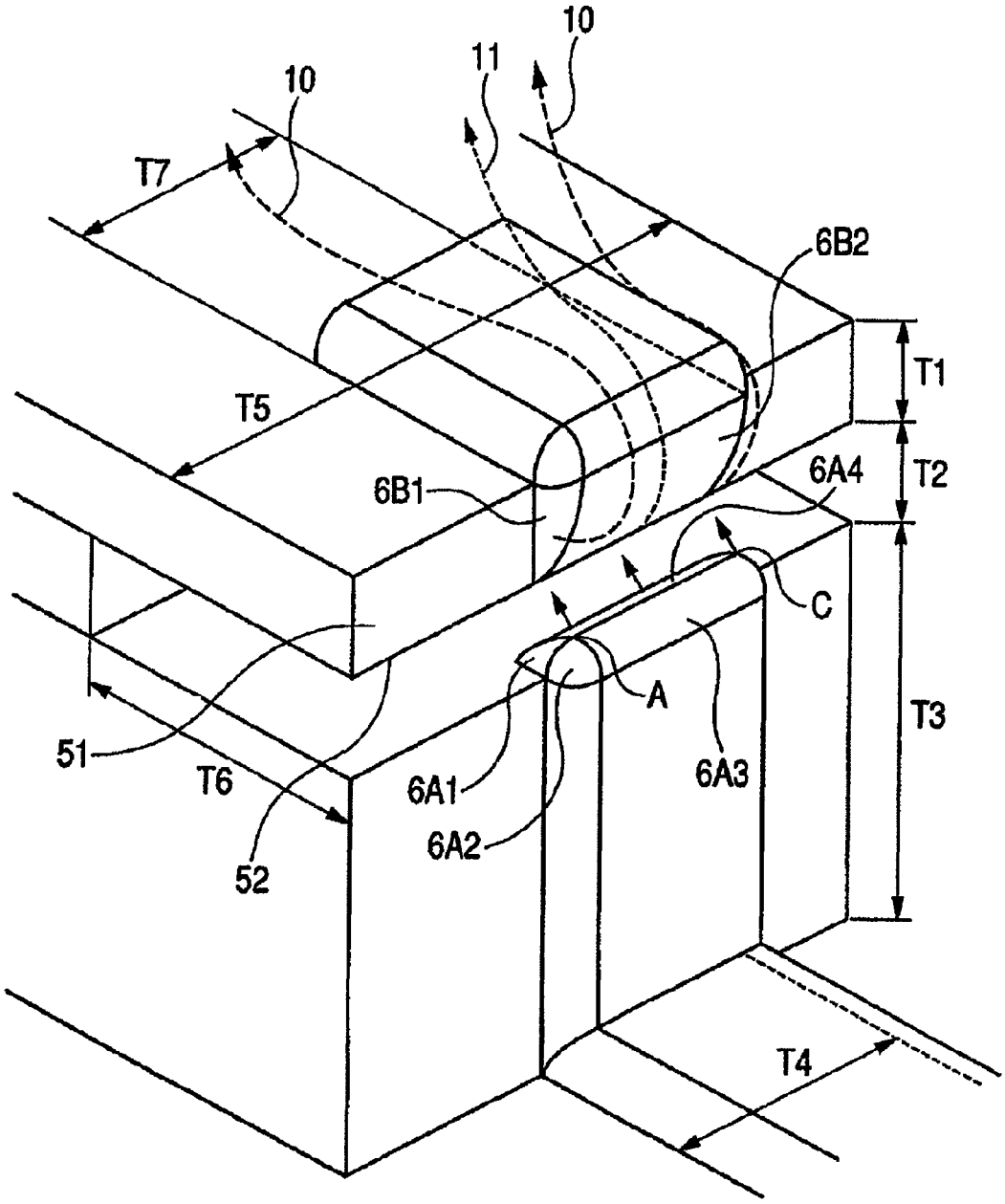
FIG. 15 is a partial enlarged view illustrating the electron-emitting device of the third embodiment.

In FIGS. 14A, 14B and 14C, insulating layers 3 and 4 form an insulating member and forms a step on the surface of the substrate 1. The gate electrode 5 is positioned on the outer surface of the insulating member (on the insulating layer 4 forming a part of the insulating member). The strip-shaped cathode 6A is formed of a conductive material, electrically connected to the electrode 2 and provided on the outer surface of the insulating layer 3 being a part of the insulating member. The humped portion 6B of the gate electrode is formed of the material same as that for the cathode forming the electron emission portion and connected to the gate electrode. Incidentally, the humped portion 6B is formed on the upper surface and the side of the gate electrode 5. The recess portion 7 is formed such that the side of the insulating layer 4 is retracted inside to be concaved with respect to the outer surface (side) of the insulating layer 3 being a part of the insulating member and the side of the gate electrode 5. Although not illustrated in FIGS. 14A, 14B and 14C, over the cathodes 6A and the gate electrode 5 there is provided the anode electrode which is fixed to an electric potential higher than the electric potential applied to the above components and positioned in opposition thereto (refer to reference numeral 20 in FIG. 2). The gap 8 between which an electric field required for emitting electrons is formed represents the shortest distance between the tip of protruding portion of the cathodes 6A and the bottom surface (the portion opposing the recess) of the gate electrode 5. FIG. 15 is a bird's eye enlarged view in the vicinity of the emission portion of the device in FIGS. 14A, 14B and 14C.

An example of a method of producing the electron-emitting device according to the embodiment of the present invention is described below with reference to FIGS. 16 and 17. FIGS. 16 and 17 are schematic diagrams illustrating stepwise a production process for the electron-emitting device according to the embodiment of the present invention.

A substrate 1 is one for mechanically supporting the device and uses PD200 being low sodium glass developed for a plasma display in the present embodiment.

Figure 16A:
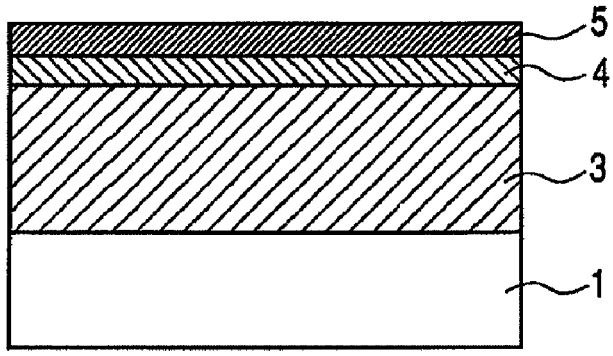
FIGS. 16A, 16B and 16C are a set of schematic diagrams illustrating a method of producing another electron-emitting device of the present invention.

First of all, as illustrated in FIG. 16A, the insulating layers 3 and 4 and the gate electrode 5 are stacked on the substrate 1.

The insulating layer 3 is an insulating film made of a material excellent in workability. An SiN ($Si_2N_y$) film was formed by the sputtering method and was 500 nm in thickness.

The insulating layer 4 is made of $SiO_2$ being an insulating film formed of a material excellent in workability. The film was produced by sputtering method and was 40 nm in thickness.

The gate electrode 5 is made of a TaN. The film was formed by the sputtering method and was 40 nm in thickness.

Figure 16B:
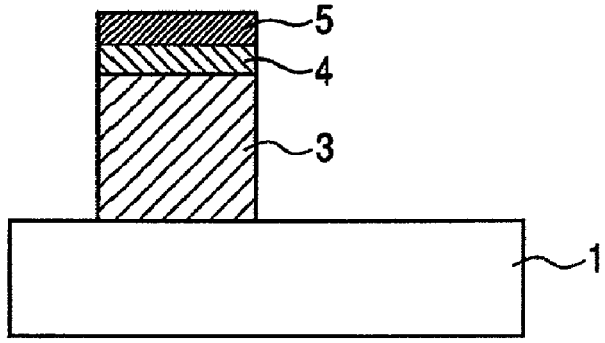

As illustrated in FIG. 16B, a resist pattern is formed on the gate electrode by a photolithography technique and then the gate electrode 5, the insulating layer 4 and the insulating layer 3 are processed in this order by a dry etching method.

As processing gas in this case, there was used $CF_4$ gas because the insulating layers 3 and 4 and the gate electrode 5 had been formed of the materials which yield fluoride as described above. Performing RIE using the gas formed an angle of approximately 80 degrees with respect to the horizontal surface of the substrate after the insulating layers 3 and 4 forming the insulating member and the gate material 5 were etched.

Figure 16C:
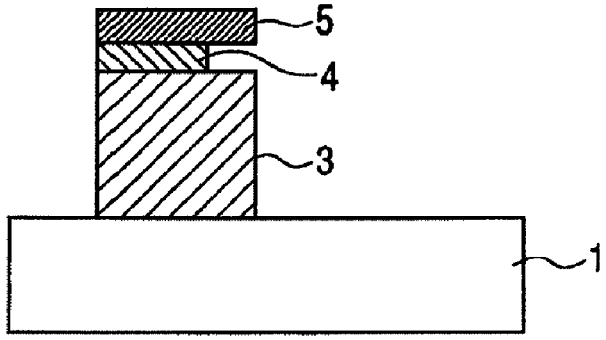

After the resist was removed, as illustrated in FIG. 16C, the insulating layer 4 being a part of the insulating member was etched by the etching method using BHF to form an approximately 100 nm deep recess in the insulating member of the insulating layers 3 and 4.

Figure 17A:
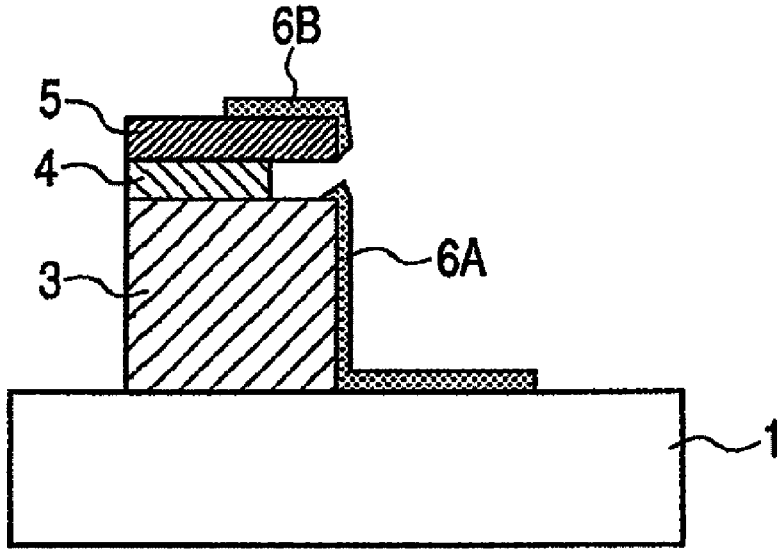
FIGS. 17A and 17B are another set of schematic diagrams illustrating a method of producing another electron-emitting device of the present invention.

As is the case with the second embodiment, as illustrated in FIG. 17A, molybdenum (Mo) being the cathode material forming the electron emission portion is caused to adhere also to the gate electrode. In the present embodiment, an EB vapor deposition method was used as a film formation method. In the formation method, the angle of the substrate was set to 60 degrees. Thereby, Mo was injected onto the upper portion of the gate at 60 degrees and onto the RIE processed outer surface of the insulating layer 3 being a part of the insulating material at 40 degrees. A vapor deposition was performed at its rate of approximately 10 nm/min for four minutes.

The vapor deposition time was precisely controlled such that the Mo on the outer surface of the insulating member was 40 nm in thickness, an amount of the cathode entering the recess was 33 nm and an angle made by the inner surface of the recess (the upper surface of the insulating layer 3) and the cathode being the electron emission portion was 120 degrees.

A resist pattern was formed by the photolithography technique so that the width T4 of the conductive layer 6A can be 600 μm and the width T7 of the humped portion 6B of the gate can be smaller by approximately 30 nm than the width T4. Incidentally, the width T7 of the humped portion 6B of the gate is controlled by the tapered shape of the resist pattern on the gate electrode 5. After that, the molybdenum cathode 6A and the humped portion 6B of the gate were processed by dry etching method. As processing gas in this case, there was used $CF_4$ gas because the molybdenum used as the material for the protruding portion of the cathode and the humped portion of the gate is a material yielding fluoride. Thereby, the cathode 6A including the protruding portion serving as the electron emission portion along the edge of the recess of the insulating member and the humped portion 6B of the gate electrode 5 positioned in opposition to the protruding portion were processed in a strip shape.

A cross-section TEM analysis showed that the shortest distance 8 was 15 nm between the protruding portion of the cathode and the humped portion of the gate in FIG. 14B.

Figure 17B:
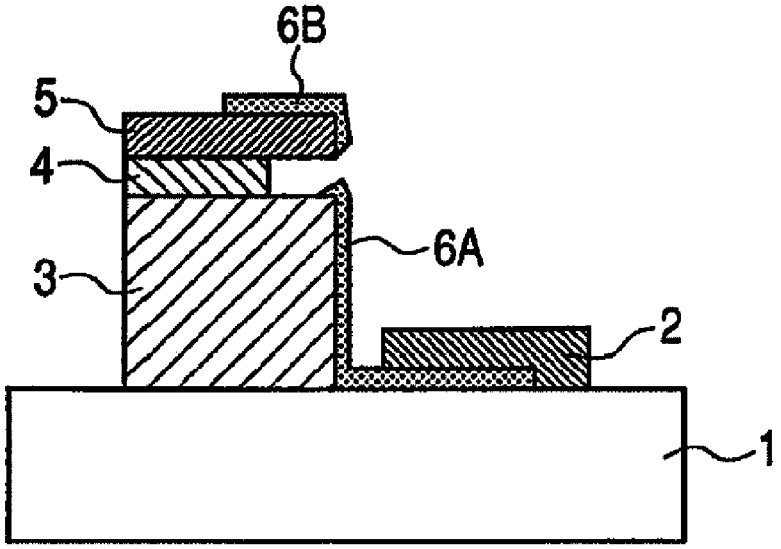

As illustrated FIG. 17B, the electrode 2 was formed. Copper (Cu) was used for the electrode 2. The electrode 2 was formed by the sputtering method and was 500 nm in thickness.

After the device was formed by the above method, the characteristic of the electron source was evaluated with the configuration illustrated in FIG. 2.

As a result of evaluation of characteristic of the configuration, the electric potential of the gate electrode 5 and the humped portion 6B was taken as 35 V and the electric potential of the cathode 6A was fixed to 0 V through the electrode 2, thereby a driving voltage of V was applied between the gate electrode and the cathode 6A. As a result, there was obtained the device with an average electron emission current Ie of 1.5 μA and an average efficiency of 20%. As is the case with the above other embodiments, also in the configuration, the cathode entering the recess of the insulating member to bring the cathode into contact with the inner surface of the recess has improved a thermal and mechanical stability. As a result, there was obtained an excellent electron-emitting device which is as small as approximately 4% in variation (reduction) of the current Ie and stably operates even if the device is continuously driven.

The characteristic of the electron-emitting device of the present embodiment is briefly described below using FIG. 15. FIG. 15 is the same as FIG. 3 except that the humped portion 6B is provided on the electrode 5 and the width of the humped portion 6B is taken as T7. In other words, T7 is a length in the direction along the edge of the recess of the insulating member.

In FIG. 15, electrons emitted from the end of the protruding portion of the cathode being the electron emission portion partly collide with the gate electrode 5 and the humped portion 6B of the gate opposing the end and partly drawn outside without collision. The electrons colliding with the humped portion 6B of the gate electrode collide with surface elements 6B1 and 6B2. Both of the electrons colliding with surface elements 6B1 and 6B2 are isotropically scattered. The number of electrons escaping from the electron orbit in the case where electrons are scattered on the surface elements 6B1 and 6B2 was counted, which showed that an escaping probability is higher on the surface element 6B1 than on the surface element 6B2. From that reason, it was analytically found that a relationship between the width T4 of the protruding portion being the electron emission portion of the cathode 6A and the width T7 of the humped portion of the gate electrode is fixed to T4≧T7 to improve an efficiency by several % to several tens of %. When a difference between T4 and T7 is twice or more as much as T2 being the height of the insulating layer 4, particularly the efficiency is improved. As described above, the width (T4) of the protruding portion is a length of the protruding portion of the conductive layer 6A measured in the direction along the edge of the recess of the insulating member. Similarly, the width (T7) of the humped portion is a length of the humped portion 6B of the gate electrode 5 measured in the direction along the edge of the recess of the insulating member.

Fourth Embodiment

Figure 18A:
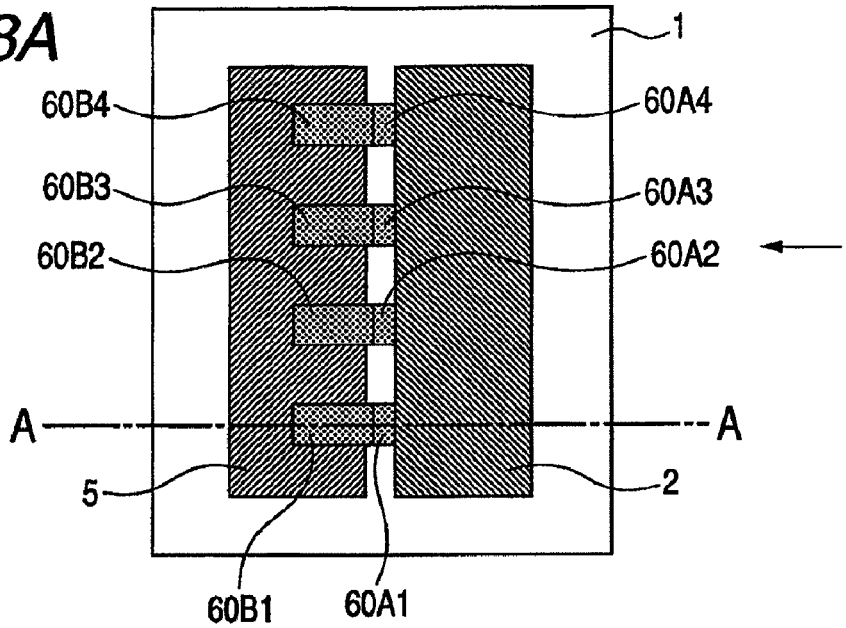
FIGS. 18A, 18B and 18C are a set of schematic diagrams illustrating the electron-emitting device of a fourth embodiment.
Figure 18B:
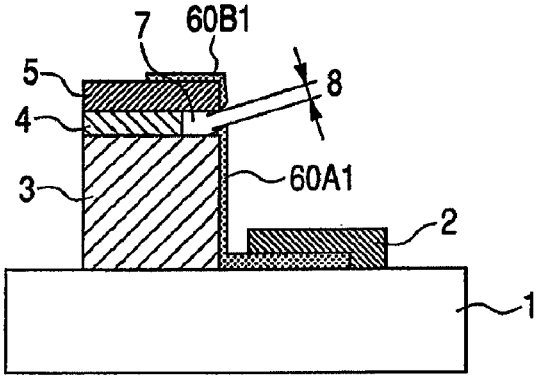
Figure 18C:
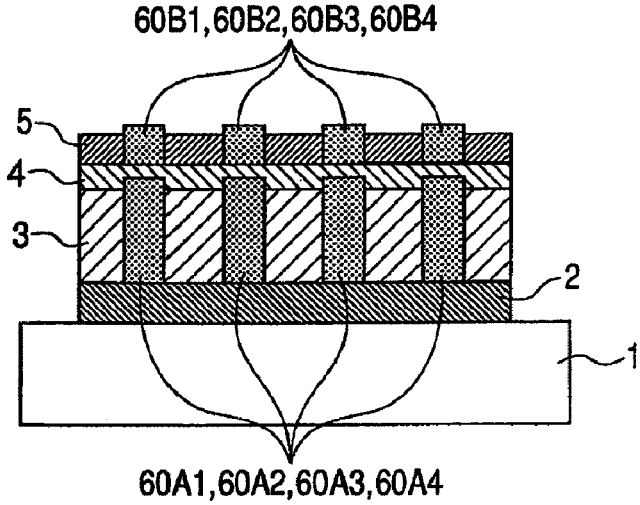

FIG. 18A is a plan schematic diagram of the electron-emitting device according to the embodiment of the present invention. FIG. 18B is a cross section taken along the line A-A of FIG. 18A. FIG. 18C is a side view when the device is viewed from the direction indicated by the arrow in FIG. 18A.

In FIGS. 18A, 18B and 18C, insulating layers 3 and 4 form an insulating member and forms a step on the surface of the substrate 1. The gate electrode 5 is positioned on the outer surface of the insulating member (the upper surface of the insulating layer 4 forming a part of the insulating member). Strip-shaped cathodes 60A1 to 60A4 are electrically connected to the electrode and provided on the outer surface of the insulating layer 3 being a part of the insulating member. Strip-shaped humped portions 60B1 to 60B4 are formed of a conductive material and electrically connected to the gate electrode. The protruding portions 60B1 to 60B4 are the upper surface and the side of the gate electrode 5. The recess portion 7 is formed such that the side of the insulating layer 4 is retracted inside to be concaved with respect to the outer surface (side) of the insulating layer 3 being a part of the insulating member and the side of the gate electrode 5. Although not illustrated in FIGS. 18A, 18B and 18C, over the cathodes 60A1 to 60A4 and the gate electrode 5 there is provided the anode electrode which is fixed to an electric potential higher than the electric potential applied to the above components and positioned in opposition thereto (refer to reference numeral 20 in FIG. 2). The gap 8 between which an electric field required for emitting electrons is formed represents the shortest distance between the tip of protruding portion of the cathodes 60A1 to 60A4 and the bottom surface of the humped portions 60B1 to 60B4 of the gate electrode (the portion opposing the recess).

Since the production method of the fourth embodiment is basically the same as that of the third embodiment, only the points different from the third embodiment are described below.

As illustrated in FIG. 17B, molybdenum (Mo) being the cathode material forming the electron emission portion is caused to adhere also to the gate electrode. In the present embodiment, the sputtering vapor deposition method was used as a film formation method. In the formation method, the angle of the substrate was set horizontal with respect to a sputtering target. In the sputtering film formation, argon plasma is generated in a vacuum of 0.1 Pa and the substrate is placed in a distance of 60 mm or less between the substrate and the Mo target (mean free path at 0.1 Pa) so that sputtering particles are injected to the substrate surface at a limited angle. The molybdenum film was formed at a vapor deposition rate of 10 nm/min so that the thickness of the Mo film on the outer surface of the insulating layer 3 being a part of the insulating member can be 20 nm. At this point, the molybdenum film was formed so that an amount of the cathode entering the recess could be 40 nm and an angle made by the inner surface of the recess (the upper surface of the insulating layer 3) and the protruding portion of the cathode being the electron emission portion could be 150 degrees.

After the molybdenum film was formed, a resist pattern was formed by the photolithography technique so that the width T4 (FIG. 15) of the cathodes 60A1 to 60A4 can have a line-and-space of 3 μm.

Thereafter, the molybdenum cathodes 60A1 to 60A4 and the humped portions 60B1 to 60B4 of the gate electrode were processed by the dry etching method. As processing gas in this case, there was used $CF_4$ gas because the molybdenum used as the material for the protruding portion of the cathode and the humped portion of the gate is a material yielding fluoride. Thereby, the cathodes 60A1 to 60A4 including the protruding portion serving as the electron emission portion along the edge of the recess of the insulating member and the humped portions 60B1 to 60B4 of the gate electrode 5 positioned in opposition to the protruding portion were processed in a strip shape. Measurement of the width of the completed protruding portion of the cathode and the humped portion of the gate electrode showed that the width T7 of the humped portions 60B1 to 60B4 of the gate was smaller by approximately 10 nm to 30 nm than the width T4 of the conductive layers 60A1 to 60A4 forming the electron emission portion. As is the case with the above embodiments, since the cathode is processed in a strip shape, the width T4 is also the width of the protruding portion. Incidentally, the width of the protruding portion means a length of the protruding portion of the cathode 60A in the direction along the edge of the recess of the insulating member. Similarly, the width of the humped portion of the gate electrode means a length in the direction along the recess of the insulating member.

A cross-section TEM analysis showed that the shortest distance 8 was 8.5 nm on an average between the protruding portion of the cathode being the electron emission portion and the humped portion of the gate electrode in FIG. 18B.

Also in the present embodiment, as is the case with the other embodiments, the protruding portion of the cathode serving as the electron emission portion was caused to enter the recess of the insulating member to bring the protruding portion of the cathode into contact with the inner surface of the recess. This improves a thermal and mechanical stability to realize an excellent electron-emitting device which is as small as approximately 3% in variation (reduction) of the current Ie and stably operates even if the device is continuously driven. Furthermore, as is the case with the second embodiment, a single electron-emitting device including a plurality of the strip-shaped cathodes can provide an electron beam source whose electron beam is further refined in shape than in a conventional electron-emitting device. In other words, there can be provided the electron-emitting device which eliminates difficulty in control of an electron beam shape due to an electron emission point being unspecific, like the conventional electron-emitting device, and emits electron beams refined in shape by merely controlling the layout of the strip-shaped cathodes. Still furthermore, the humped portion 60B was provided on the gate and the width (T7) thereof was made not more than the width (T4) of the cathode 60A having the electron emission portion, desirably made smaller than that, thereby enabled a higher efficient electron beam source to be formed.

The aforementioned image display apparatus was formed using the electron beam apparatus in the above second and fourth embodiments to enable providing the display apparatus excellent in an electron beam formation, thereby realizing the display apparatus excellent in displayed image.

In all the above embodiments, the portion of the gate electrode 5 opposing the recess of the insulating member (the lower surface of the gate electrode) may be desirably coated with an insulating layer. Out of the electrons emitted from the electron emission portion (the tip of the protruding portion of the conductive layer), the electrons with which the lower surface of the gate is irradiated do not reach the anode to result in reduction in efficiency (the foregoing current If component). Covering the lower surface of the gate electrode with the insulating layer enables the current If to be reduced, improving the efficiency. As the insulating layer with which the portion of the gate electrode 5 opposing the recess of the insulating member (the lower surface of the gate electrode) is coated, there may be used, for example, SiN film approximately 20 nm in thickness, which has confirmed that this configuration can bring about a sufficient effect for improving the efficiency.

The image display apparatus using the thus configured electron beam apparatus can also provide the display apparatus excellent in an electron beam formation as is the case with the abovementioned image display apparatus and enables realizing the display apparatus excellent in displayed image and low in power consumption caused by improvement in the efficiency.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-102624, filed Apr. 10, 2008, which is hereby incorporated by reference herein in its entirety.

What is claimed is:

1. An electron-emitting device comprising:

an insulating member having a recess on a surface thereof, the surface of the insulating member having an inner surface and an outer surface, the inner surface forming the recess and the outer surface continuing to the inner surface along an edge of the recess;

a gate disposed on the outer surface; and a cathode disposed on the outer surface, the cathode having a protruding portion in opposition to the gate, the protruding portion contacting with the inner surface.

2. The electron-emitting device according to claim 1, wherein the protruding portion protrudes from the edge of the recess toward the gate.

3. The electron-emitting device according to claim 2, wherein the protruding portion contacts with the inner surface at an angle of equal to or larger than 90 degrees.

4. The electron-emitting device according to claim 1, wherein the gate has an opposing portion being in opposition to the recess, extending in an outside of the outer surface toward the protruding portion.

5. The electron-emitting device according to claim 4, wherein the protruding portion has, at a side of the recess, a portion shaped to be inclined from a line normal to a surface of the opposing portion facing the inner surface.

6. The electron-emitting device according to claim 4, wherein a surface of the opposing portion facing the inner surface is covered with an insulating layer.

7. The electron-emitting device according to claim 4, wherein a surface of the opposing portion not facing the inner surface, is covered with a film made of a same material as a material of the cathode.

8. The electron-emitting device according to claim 1, wherein the protruding portion is arranged along the edge of the recess, the gate has a humped portion disposed in opposition to the protruding portion, and a length of the humped portion in a direction along the edge of the recess is not larger than a length of the protruding portion in the direction along the edge of the recess.

9. The electron-emitting device according to claim 1, wherein a plurality of protruding portions are arranged per gate along the edge of the recess.

10. An electron source comprising a plurality of the electron-emitting devices according to claim 1, arranged on a substrate.

11. An electron beam apparatus comprising:

the electron-emitting device according to claim 1; and an anode, wherein the gate is positioned between the anode and the protruding portion.

12. An image display apparatus comprising:
the electron-emitting device according to claim 1;
an anode; and
a light emitting member disposed on the anode, wherein the gate is positioned between the anode and the protruding portion.

13. An electron-emitting device comprising:
an insulating member;
a cathode disposed on a surface of the insulating member; and
a gate disposed on the surface of the insulating member so as to be opposite to a tip of the cathode,
wherein the insulating member has a recess on the surface where the tip of the cathode is positioned,
the tip of the cathode has a protruding portion protruding from an edge of the recess on the surface of the insulating member toward the gate, and
the cathode having the protruding portion is positioned so as to extend from the surface of the insulating member to an inside surface of the recess.

14. The electron-emitting device according to claim 13, wherein the protruding portion contacts the inside surface of the recess at an angle of equal to or larger than 90 degrees.

15. The electron-emitting device according to claim 13, wherein the protruding portion is positioned along the edge of the recess, the gate has a humped portion on its portion opposite to the protruding portion, and the humped portion has a length in a direction along the edge of the recess is equal to or shorter than a length of the protruding portion along the edge of the recess.

16. The electron-emitting device according to claim 13, wherein the protruding portion has, at a side of the recess, a portion shaped to be inclined from a line normal to a surface of a part of the gate opposite to the recess.

17. The electron-emitting device according to claim 13, wherein the plurality of cathodes are provided.

18. The electron-emitting device according to claim 13, wherein the gate is covered with an insulating layer at a portion opposite to the recess.

19. An electron source comprising a plurality of the electron-emitting devices according to claim 13, arranged on a substrate.

20. An electron beam apparatus comprising:
the electron-emitting device according to claim 13; and
an anode,
wherein the gate is positioned between the anode and the protruding portion.

21. An image display apparatus comprising:
the electron-emitting device according to claim 13;
an anode; and
a light emitting member disposed on the anode,
wherein the gate is positioned between the anode and the protruding portion.

22. An electron-emitting device comprising:
an insulating member disposed on a substrate, the insulating member having a recess on a surface of the insulating member and having a side surface and an upper surface, the side surface continuing to the recess and extending toward the substrate, the upper surface more distantly extending from the substrate than the side surface and continuing to the recess;
a cathode disposed on the side surface, the cathode having a protruding portion protruding from an edge of the recess, at which the side surface continues to the recess, toward a direction away from the substrate; and
a gate disposed on the upper surface in opposition to the protruding portion,
wherein the protruding portion contacts with the recess.

23. The electron-emitting device according to claim 22, wherein the side face leans with respect to a surface of the substrate.

24. The electron-emitting device according to claim 22, wherein the substrate is insulative and the insulating member is in contact with the substrate, and the cathode extends along the substrate without extending between the insulating member and the substrate.

25. The electron-emitting device according to claim 22, wherein the gate has an opposing portion being in opposition to the recess and extending in an outside of the upper surface toward the protruding portion.

26. The electron-emitting device according to claim 25, wherein the protruding portion has, on a recess side of a tip of the protruding portion, a part shaped to be inclined from a line normal to a surface of the opposing portion facing the recess.

27. The electron-emitting device according to claim 25, wherein a surface of the opposing portion facing the recess is covered with an insulating layer.

28. The electron-emitting device according to claim 25, wherein a surface of the opposing portion not facing the recess, is covered with a film made of a same material as a material of the cathode.

29. The electron-emitting device according to claim 22, wherein the protruding portion contacts with the recess at an angle of equal to or larger than 90 degrees.

30. The electron-emitting device according to claim 22, wherein the protruding portion is disposed along the edge of the recess, the gate has a humped portion opposite to the protruding portion, and a length of the humped portion in a direction along the edge of the recess is equal to or shorter than a length of the protruding portion in the direction along the edge of the recess.

31. The electron-emitting device according to claim 22, wherein a plurality of protruding portions are arranged per gate along the edge of the recess.

32. An electron source comprising a plurality of the electron-emitting devices according to claim 22, arranged on the substrate.

33. An electron beam apparatus comprising:
the electron-emitting device according to claim 22; and
an anode,
wherein the gate is positioned between the anode and the protruding portion.

34. An image display apparatus comprising:
the electron-emitting device according to claim 22;
an anode; and
a light emitting member disposed on the anode,
wherein the gate is positioned between the anode and the protruding portion.

* * * * *